US007424814B2

(12) United States Patent
Jasper

(10) Patent No.: US 7,424,814 B2
(45) **Date of Patent: *Sep. 16, 2008**

(54) DEAD BOLT LOCK SYSTEM HAVING MULTIPLE SECURITY FEATURES

(75) Inventor: Thomas E. Jasper, Bryantsville, KY (US)

(73) Assignee: Lockmasters, Inc., Nicholasville, KY (US)

( * ) Notice: Subject to any disclaimer, the term of this patent is extended or adjusted under 35 U.S.C. 154(b) by 194 days.

This patent is subject to a terminal disclaimer.

(21) Appl. No.: 11/315,622

(22) Filed: Dec. 22, 2005

(65) Prior Publication Data

US 2006/0096338 A1 May 11, 2006

Related U.S. Application Data

(63) Continuation-in-part of application No. 10/667,959, filed on Sep. 22, 2003, now Pat. No. 7,007,524, which is a continuation-in-part of application No. 09/661,689, filed on Sep. 14, 2000, now Pat. No. 6,622,534, which is a continuation of application No. 09/090,626, filed on Jun. 4, 1998, now abandoned, which is a continuation-in-part of application No. 08/797,438, filed on Feb. 10, 1997, now abandoned.

(51) Int. Cl.
*E05B 65/10* (2006.01)

(52) U.S. Cl. ..... 70/92; 70/210; 70/283; 70/422; 292/92; 292/DIG. 22

(58) Field of Classification Search ..... 70/210, 70/283, DIG. 63, 223, 422, 472, 131, 284, 70/285, 92; 109/59 R, 59 T; 292/92, DIG. 22
See application file for complete search history.

(56) References Cited

U.S. PATENT DOCUMENTS

| | | | | |
|---|---|---|---|---|
| 450,290 | A | 4/1891 | Hansen | |
| 780,181 | A | 1/1905 | Holden | 70/118 |
| 928,904 | A | 7/1909 | Cottrell | 70/118 |
| 943,143 | A | 12/1909 | Draper | 292/165 |
| 1,288,816 | A | 12/1918 | Bolles | |

(Continued)

FOREIGN PATENT DOCUMENTS

| | | |
|---|---|---|
| DE | 302222 | 12/1917 |

(Continued)

*Primary Examiner*—Lloyd A Gall
(74) *Attorney, Agent, or Firm*—Wood, Herron & Evans L.L.P.

(57) ABSTRACT

A dead bolt lock system having one or more security locks in conjunction with a dead bolt to provide various levels of security access to a door. An inertia assembly restrains movement of the dead bolt when a shock load is applied to the door, but allows the dead bolt to move when a shock load is not present. The inertia assembly includes an actuator weight and a bolt lock lever that can translate and rotate in response to the application of the shock load. In addition, the inertia assembly includes a return spring that biases the inertia assembly back into its original position for facilitating movement of the dead bolt after the application of the shock load.

15 Claims, 24 Drawing Sheets

U.S. PATENT DOCUMENTS

| | | | | | |
|---|---|---|---|---|---|
| 1,496,894 | A | | 6/1924 | Krautter | |
| 1,512,939 | A | | 10/1924 | Ledin | |
| 1,604,866 | A | | 10/1926 | Wildrick | 70/284 |
| 1,630,141 | A | | 5/1927 | Soemer | |
| 1,756,667 | A | | 4/1930 | Soemer | 292/165 X |
| 1,805,997 | A | | 5/1931 | Rhiner | 292/165 |
| 1,897,080 | A | | 2/1933 | Soper | 292/165 |
| 2,233,828 | A | | 3/1941 | Andersen | 292/165 X |
| 2,241,109 | A | | 5/1941 | Bock | 292/346 |
| 2,243,179 | A | | 5/1941 | Whittier | 292/169.14 |
| 2,485,042 | A | | 10/1949 | Friend | 292/167 X |
| 2,524,696 | A | | 10/1950 | Ellis | 70/422 |
| 2,594,253 | A | | 4/1952 | Vander Veer | 292/92 |
| 2,843,409 | A | | 7/1958 | Johannesen | 292/165 |
| 2,872,233 | A | | 2/1959 | Bordner, Jr. | 292/92 |
| 2,958,215 | A | | 11/1960 | Heyman | 70/92 |
| 3,073,143 | A | | 1/1963 | Eads | 292/169.14 |
| 3,271,062 | A | | 9/1966 | Schelin | 292/336.3 |
| 3,339,959 | A | | 9/1967 | Krantz | 292/254 |
| 3,633,388 | A | | 1/1972 | Atkinson | 70/285 X |
| 3,719,248 | A | | 3/1973 | Breitschwerdt et al. | 180/112 |
| 3,774,420 | A | | 11/1973 | Orr | 70/131 X |
| 3,796,073 | A | | 3/1974 | Gulraud | 70/432 X |
| 3,799,596 | A | * | 3/1974 | Nozomu et al. | 292/216 |
| 3,865,414 | A | | 2/1975 | Schlage | 292/165 X |
| 3,869,159 | A | | 3/1975 | Eads | 292/92 |
| 3,958,820 | A | | 5/1976 | Teeple | 292/92 |
| 4,003,593 | A | | 1/1977 | Wilzig et al. | 292/92 |
| 4,006,471 | A | | 2/1977 | Pappas | 70/432 |
| 4,064,719 | A | | 12/1977 | Boeckman et al. | 70/355 |
| 4,101,153 | A | | 7/1978 | Dozier | 292/92 |
| 4,268,076 | A | | 5/1981 | Itoi | 70/279.1 X |
| 4,290,634 | A | * | 9/1981 | Gelhard | 292/201 |
| 4,312,528 | A | | 1/1982 | Hall et al. | 292/92 |
| 4,389,061 | A | | 6/1983 | Foshee | 292/169.14 |
| 4,470,277 | A | | 9/1984 | Uyeda | 70/118 |
| 4,536,021 | A | * | 8/1985 | Mochida | 292/201 |
| 4,629,228 | A | | 12/1986 | Marko et al. | 292/165 |
| 4,634,155 | A | | 1/1987 | Geringer et al. | 292/144 |
| 4,669,394 | A | | 6/1987 | Fogleman et al. | 109/597 |
| 4,679,834 | A | | 7/1987 | Gotanda | 292/169.13 |
| 4,688,492 | A | | 8/1987 | Peghetti | 109/597 |
| 4,714,282 | A | * | 12/1987 | Henderson | 292/36 |
| 4,754,715 | A | | 7/1988 | Squires | 109/597 |
| 5,040,652 | A | | 8/1991 | Fish et al. | 70/187 |
| 5,044,182 | A | | 9/1991 | Totten | 292/169.14 X |
| 5,139,292 | A | | 8/1992 | Beals | 292/92 |
| 5,249,831 | A | * | 10/1993 | Maniaci | 292/144 |
| 5,308,130 | A | * | 5/1994 | Lee | 292/336.3 |
| 5,473,922 | A | | 12/1995 | Bair et al. | 70/333 R |
| 5,487,289 | A | | 1/1996 | Otto, III et al. | 70/210 |
| 5,495,733 | A | | 3/1996 | Yen et al. | 70/284 X |
| 5,632,170 | A | | 5/1997 | Evans | 70/333 R |
| 5,669,642 | A | | 9/1997 | Kang | 292/336.3 |
| 5,819,563 | A | | 10/1998 | Bianco | 70/472 X |
| 5,862,692 | A | | 1/1999 | Legault et al. | 70/278 |
| 5,865,481 | A | * | 2/1999 | Buschmann | 292/216 |
| 6,007,122 | A | | 12/1999 | Linder et al. | 292/336.3 |
| 6,070,923 | A | | 6/2000 | Tanimoto et al. | 292/336.3 |
| 6,565,134 | B1 | | 5/2003 | Stuart et al. | 292/336.3 |
| 6,575,508 | B2 | | 6/2003 | Stuart et al. | 292/336.3 |
| 6,622,534 | B1 | | 9/2003 | Miller et al. | 70/92 |
| 6,648,382 | B1 | | 11/2003 | Monig et al. | 292/336.3 |
| 6,709,033 | B2 | | 3/2004 | Jooss et al. | 292/336.3 |
| 7,007,524 | B2 | * | 3/2006 | Jasper | 70/92 |

FOREIGN PATENT DOCUMENTS

| | | |
|---|---|---|
| DE | 498939 | 5/1930 |
| FR | 817076 | 8/1937 |
| GB | 10530 | 7/1888 |
| GB | 2039983 | 8/1980 |

* cited by examiner

DEAD BOLT LOCK SYSTEM HAVING MULTIPLE SECURITY FEATURES

CROSS REFERENCE TO RELATED APPLICATIONS

This application is a continuation-in-part of prior U.S. application Ser. No. 10/667,959, filed Sep. 22, 2003, now U.S. Pat. No. 7,007,524, which is a continuation-in-part of prior U.S. application Ser. No. 09/661,689 filed Sep. 14, 2000, now U.S. Pat. No. 6,622,534, which is a continuation of prior U.S. application Ser. No. 09/090,626, filed Jun. 4, 1998 (now abandoned), which is a continuation-in-part of prior U.S. application Ser. No. 08/797,438, filed Feb. 10, 1997 (now abandoned). The disclosure of each of these applications is hereby incorporated by reference herein in its entirety.

FIELD OF THE INVENTION

The present invention is directed generally to dead bolt locks and, more particularly, to dead bolt locks used on doors for accessing secure areas.

BACKGROUND OF THE INVENTION

The use of dead bolts for security purposes is widespread. One example of a high security dead bolt lock is shown in U.S. Pat. No. 5,257,519 to Miller, the disclosure of which is incorporated herein by reference. Another example of these types of dead bolt mechanisms is shown in U.S. Pat. No. 4,601,504 to Wolfe, the disclosure of this patent also incorporated by reference herein. These dead bolt locks are combined with a safe lock for security purposes. The lock bolt of the safe lock provides the motive force to extend and retract the dead bolt of the dead bolt lock during operation. When using a combination type lock, a correct combination will permit retraction of the lock bolt. One drawback of such devices is that safe lock bolts and actuating mechanisms may not be well suited for long term use in this manner. In other words, they may not be designed to exert the necessary pushing or pulling force during extension and retraction of the dead bolt.

A dead bolt hold back feature has also been provided which retains the dead bolt in a retracted state. The dead bolt automatically extends as the door closes and a trigger member contacts the door strike. The extended dead bolt may be retracted from the inside of the secured area by rotation of a dead bolt knob. The aforementioned patents also disclose a life safety feature which retains the dead bolt in a retracted position so that a person inside a secured area can close the door without having the dead bolt extend. This feature enables quick exit from the secured area, however, it is not usually desirable to leave the door unlocked in this manner. On the other hand, when the life safety feature is not enabled, the above-mentioned dead bolt knobs do not provide a particularly easy manner of escape for individuals with various disabilities.

Often times, dead bolt locks on doors are combined with a second electric lock. The second lock often takes the form of an electronic access control linked to an electric door strike or lock associated with the door knob. Unlocking information provided to the access control actuates the door strike and, upon the additional retraction of any dead bolt, allows the door to be opened. It will be appreciated that this combination of a dead bolt lock and a doorknob lock makes it difficult to exit the secured area. A person leaving the secured area must use two hands to turn the doorknob and the dead bolt retraction knob simultaneously to open the door. Again, disabled individuals may have problems when trying to exit through such a door, particularly in the event of an emergency.

Further, many lock systems are vulnerable to opening through the application of shock loads, such as during an attempted unauthorized forced entry. For example, a shock load can cause a handle to rotate under its own weight potentially withdrawing a dead bolt and opening a door. Similarly, the application of a shock load can cause the dead bolt to move of its own initiative. For example, a heavy blow delivered to the dead bolt lock or door may cause the dead bolt, because of inertia, to retract into a retracted position in which the lock system is unlocked. Hence, the dead bolt lock is susceptible to unauthorized opening by a person familiar with their construction.

In view of these and other problems in this area of the lock industry, a need has developed to provide an improved dead bolt lock system.

SUMMARY OF THE INVENTION

In one general aspect, therefore, the present invention provides a dead bolt lock system for use on a door, for example, for accessing a secure area. The dead bolt lock system includes at least one security lock or access control having a movable lock member and requiring the input of correct unlocking information to change the lock from a locked to an unlocked condition. When the security lock is in an unlocked condition, a dead bolt element may be withdrawn and the door opened, for example, simply by turning a door handle on the outside of the door. In the first general aspect of this invention, a test member is provided in the dead bolt lock system, and is operatively connected to the security lock to test whether the security lock is in the locked or unlocked condition. If the security lock is unlocked, the test member can move into a space previously occupied by the movable lock member. The test member is also operatively connected to the dead bolt element such that movement of the test member in the described manner allows retraction of the dead bolt element. If the security lock is in a locked condition, then the test member is prevented from moving through the space occupied by the lock member and either the test member or other structure operatively associated with the test member prevents retraction of the dead bolt element. Preferably, this testing occurs each time the user attempts to turn the door handle.

The dead bolt lock system may be operatively coupled to more than one security lock. As an illustrative example, one security lock may be used as a primary or high security lock and one or more additional security locks may be used as secondary high or lower security locks. In each case, a locked or unlocked condition of the security lock is tested by the dead bolt lock system and, if each security lock operating in the system is found to be in an unlocked condition, the dead bolt system may be operated by the door handle to withdraw the dead bolt and open the door. The security locks may specifically include lock bolts, such as linearly extendable bolts or swing bolts, and may comprise mechanical, electrical or electro-mechanical locks. For example, in the case of locks having linearly extendable bolts, the lock bolt will block the test member when extended and will not block the test member when retracted. In the case of swing bolts, the swing bolt will block the test member when in a locked condition, but may be forced into a retracted position by the test member when in an unlocked condition. Other types of security locks and lock bolts are also within the scope of this invention. A torque override clutch is preferably connected to the door handle to prevent transmission of excessive force to the internal components of the dead bolt lock system when the system is locked and the door handle is being rotated with excessive torque.

Stated generally, the dead bolt lock can provide different levels of security and monitoring capability. By providing at least one primary lock and one secondary lock, the dead bolt lock system can have at least two levels of control or security. The primary lock in combination with the secondary lock may be used for nighttime control and the secondary lock may be used alone for daytime control. That is, the primary lock or high security lock can remain unlocked during the day and entry into the secured area can be controlled by the operation of one or more high or lower security lock devices. Another type of security lock device which may be optionally incorporated into the system is referred to herein as an access control device. This device includes an electrically actuated movable lock member which normally blocks movement of a test member similarly associated with retraction of the dead bolt element. If the movable lock member is actuated through the input of proper unlocking information, then the test member will be able to move through the space previously occupied by the movable lock member. Due to the movement of the test member in this manner, the dead bolt element will retract, for example, as the operator turns the door handle. Preferably, the access control device comprises a solenoid having an electrically actuated movable member, such as a reciprocating piston element. This device may be controlled, for example, simply by one or more push button switches or by higher security controls like card readers, retinal scanners, voice identifiers or fingerprint identifiers.

An escape lever is also provided on the interior side of the lock system and may be operated by either pushing or pulling on the lever. This actuating movement is preferably a pushing movement toward the door or a pulling movement away from the door, but may also be a sideward or up and down pushing or pulling movement. This overrides all locking mechanisms associated with the system, except for a relock feature to be discussed below, to allow quick escape from the secure area. The lever is configured to be easily operated by persons having various disabilities.

Preferably, the inventive dead bolt lock also includes one or more blocking elements positioned to receive a force applied to an end face of the dead bolt, usually during an unauthorized entry attempt. This prevents damage to the dead bolt lock system components. The blocking element may be automatically disengaged when the dead bolt is retracted during normal operation.

The preferred dead bolt lock system also includes a unique dead bolt hold back feature employing a pivoting member disposed between a spring biased trigger member and the dead bolt element. For purposes of carrying out this feature, the dead bolt element is normally spring biased in an extended position. The pivoting member cooperates with the dead bolt element to maintain the dead bolt element in a retracted position when the door is open. The trigger automatically actuates to allow the dead bolt element to extend upon contact with a door strike or the like.

As another feature of this invention, a night latch or lock down feature is provided and prevents operation of the dead bolt lock system regardless of whether the security locks are inputted with correct unlocking information. Even when the night latch feature is enabled, however, the escape lever may be operated to allow a person to leave the secure area.

As another optional feature, the dead bolt lock system may also include a lock override mechanism. This mechanism allows each of the security locks, access controls and lock down feature to be overridden from the outside of the door through the use of an appropriate key. This key may be inserted and rotated to withdraw the dead bolt without the necessity of inputting the correct unlocking information into the security locks and/or access control.

The dead bolt lock system also includes one or more interior housing covers referred to in the industry generally as locked-on-by-combination covers, but operating in a unique manner in the present invention. The covers are removable only when the dead bolt is retracted through normal operation and the outside door handle is in a rotated position. This helps prevent unauthorized access to the interior of the lock system.

Also in connection with the housing covers, relock mechanisms may be provided to ensure that the dead bolt lock system cannot be operated after removal of the housing covers. Specifically, if the housing covers are removed, the relock mechanism automatically shifts into a position that prevents operation of the dead bolt retracting structure. This provides an additional level of security against unauthorized access through the dead bolt lock system of this invention.

Electrical sensing devices, such as microswitches, can be provided to sense, monitor, audit or even control various lock operations. The most basic of these may be to indicate on a control panel, for example, whether the dead lock bolt is in a retracted or extended position. Similarly, indicator switches can be provided to detect whether the other lock bolts combined with the dead bolt are in retracted or extended positions. It is also contemplated that the indicator switches can be wired in series, for example, to provide one overall indication of a locked or unlocked condition.

Another aspect is a dead bolt lock system for use on a door leading to a secure area. The dead bolt lock system includes a housing structure adapted to be mounted on an inside of the door, a dead bolt mounted in the housing structure for movement between extended and retracted positions, and a lock coupled with the dead bolt and controlled by the input of correct unlocking information to allow movement of the dead bolt from the extended position to the retracted position. The dead bolt lock system further includes a dead bolt retracting structure operatively connected to the dead bolt such that when the lock is unlocked, at least a portion of the retracting structure is operative to allow retraction of the dead bolt and, when the lock is locked, operation of the dead bolt retracting structure is prevented thereby preventing retraction of the dead bolt. In addition, the dead bolt lock system further includes an inertia assembly mounted to the housing structure, the inertia assembly configured for contacting a portion of the dead bolt to prevent movement of the dead bolt to the retracted position during the application of a shock load.

A further aspect is a dead bolt locking system for use on a door leading to a secure area. The locking system includes an enclosed housing structure having an interior and adapted to be mounted to the door. The locking system also includes a dead bolt mounted in the interior of the housing structure for movement between an extended position in which a portion of the dead bolt extends out of the interior of the housing structure and a retracted position in which the dead bolt is more fully contained within the interior of the housing structure. The dead bolt locking system additionally includes a security lock including a casing and a lock member each contained within the interior of the housing structure and the lock member moved from a locked condition extending outwardly from the casing to an unlocked condition retracted within the casing by the input of correct unlocking information. The dead bolt locking system also includes a dead bolt retracting structure operatively connected to the dead bolt for moving the dead bolt from the extended position to the retracted position, the dead bolt retracting structure having a slotted opening with a first portion extending transversely relative to the direction of movement of the lock member and a second portion extending substantially parallel to the direction of movement of the lock member. The dead bolt locking further includes a test member mounted within the housing structure and having a portion movable within the first and second portions of the slotted opening as the dead bolt retracting structure moves the dead bolt from the extended position to the retracted position, the test member further mounted for movement relative to the dead bolt and coupled with the dead bolt retracting structure to prevent retraction of the dead bolt when the lock member is in the locked condition and movable in the transverse direction into a space created by the lock member in the unlocked condition to thereby allow retraction of the dead bolt. An inertia assembly mounted to the housing structure is also included in the dead bolt locking system. The inertia assembly is configured for contacting a portion of the dead bolt to prevent movement of the dead bolt to the retracted position during application of a shock load.

Another aspect is a dead bolt lock system for use on a door leading to a secure area. The lock system includes a housing structure adapted to be mounted on an inside of the door, a dead bolt mounted in the housing structure for movement between extended and retracted positions, a lock coupled with the dead bolt and controlled by the input of correct unlocking information to allow movement of the dead bolt from the extended position to the retracted position, a dead bolt retracting structure operatively connected to the dead bolt such that when the lock is unlocked, at least a portion of the retracting structure is operative to allow retraction of the dead bolt and, when the lock is locked, operation of the dead bolt retracting structure is prevented thereby preventing retraction of the dead bolt, and an inertia assembly having a portion mounted to the housing structure, the inertia assembly having cam surfaces for translating and rotating the inertia member into a position for contacting a portion of the dead bolt to prevent movement of the dead bolt to the retracted position during the application of a shock load.

The various features, assemblies and systems described above can be used in combination with each other or separately depending on the particular application of the dead bolt lock system. In addition, various mechanical or electrical component designs and configurations could be used within the spirit and scope of the inventive concepts.

The inventive dead bolt lock provides significant advantages over prior dead bolt locks. First, a dead bolt lock system of this invention can accept any conventional safe lock, e.g., a combination lock, mechanical lock or electro-mechanical lock, manufactured to a standard specification or, in other words, with a standard footprint. More specifically, one or more housings of the dead bolt lock system accept locks having a standard footprint, as is often required by government specifications. Moreover, the dead bolt lock system functions with a variety of security lock devices, including those using standard lock bolts which extend and retract linearly from the lock casing or locks using swing type bolts which pivot from the lock casing, for example, with a spring bias. In any case, however, the lock member or bolt does not apply or receive significant pushing or pulling force during operation of the dead bolt lock system. Because housing or support structure may be situated adjacent the lock member or bolt, and because of the torque override clutch, the system prevents significant side loads on the lock members or bolts. Security lock bolts generally are subjected to only side loads, either from the lock bolt testers as described above or from an unauthorized entry attempt. As another advantage of the invention, the security locks and access controls may be eliminated and the system will still function as a dead bolt passage set. In this type of use, for example, the lock down feature may still be a functional part of the system.

Many additional advantages and features of the invention will become more apparent upon review of the following detailed description taken in conjunction with the accompanying drawings.

DETAILED DESCRIPTION OF THE PREFERRED EMBODIMENTS

General Organization and Operation

Figure 1:
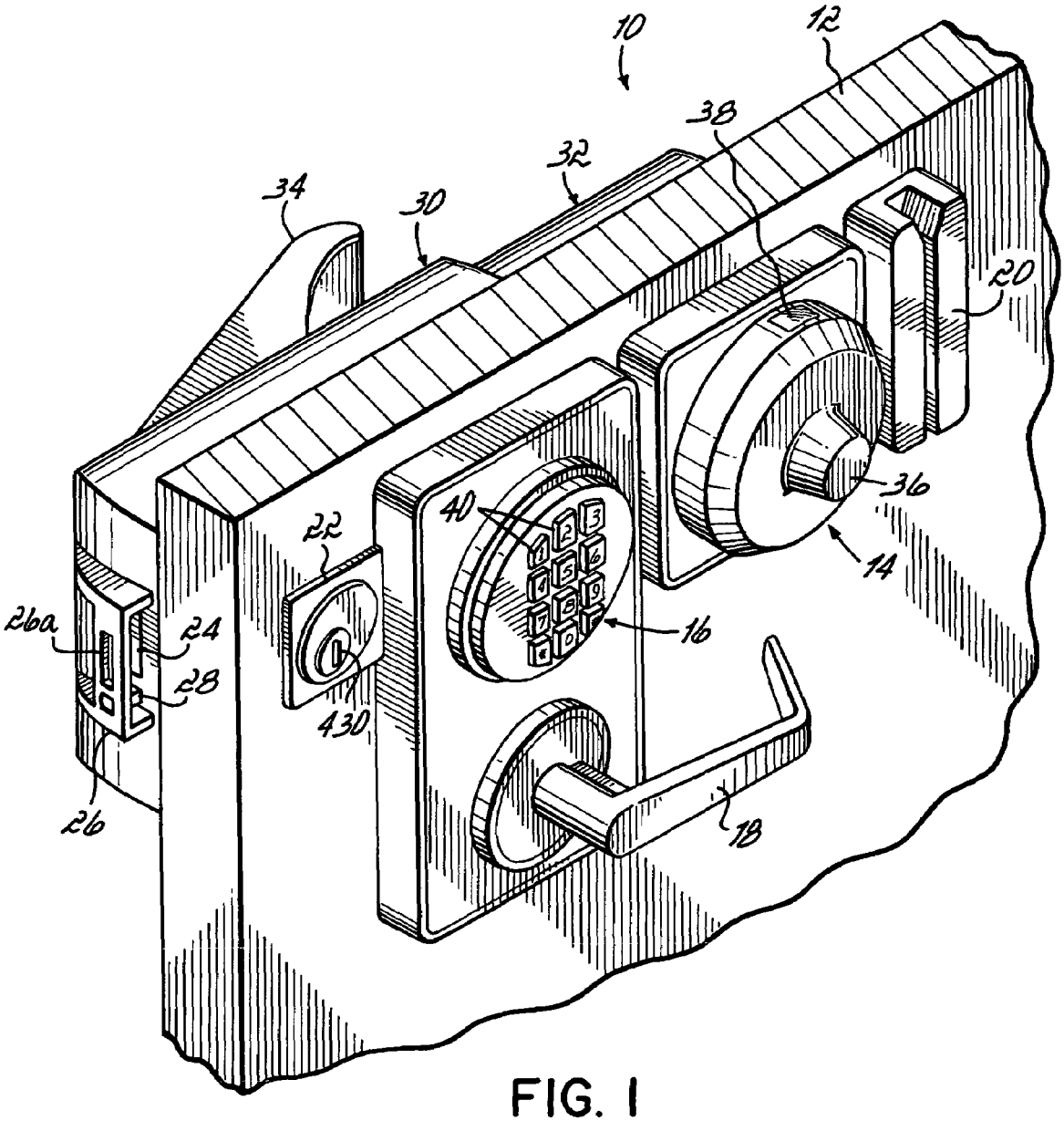
FIG. 1 is a perspective view of one preferred embodiment of the invention showing the dead bolt lock system components from the outside of a door.
Figure 2:
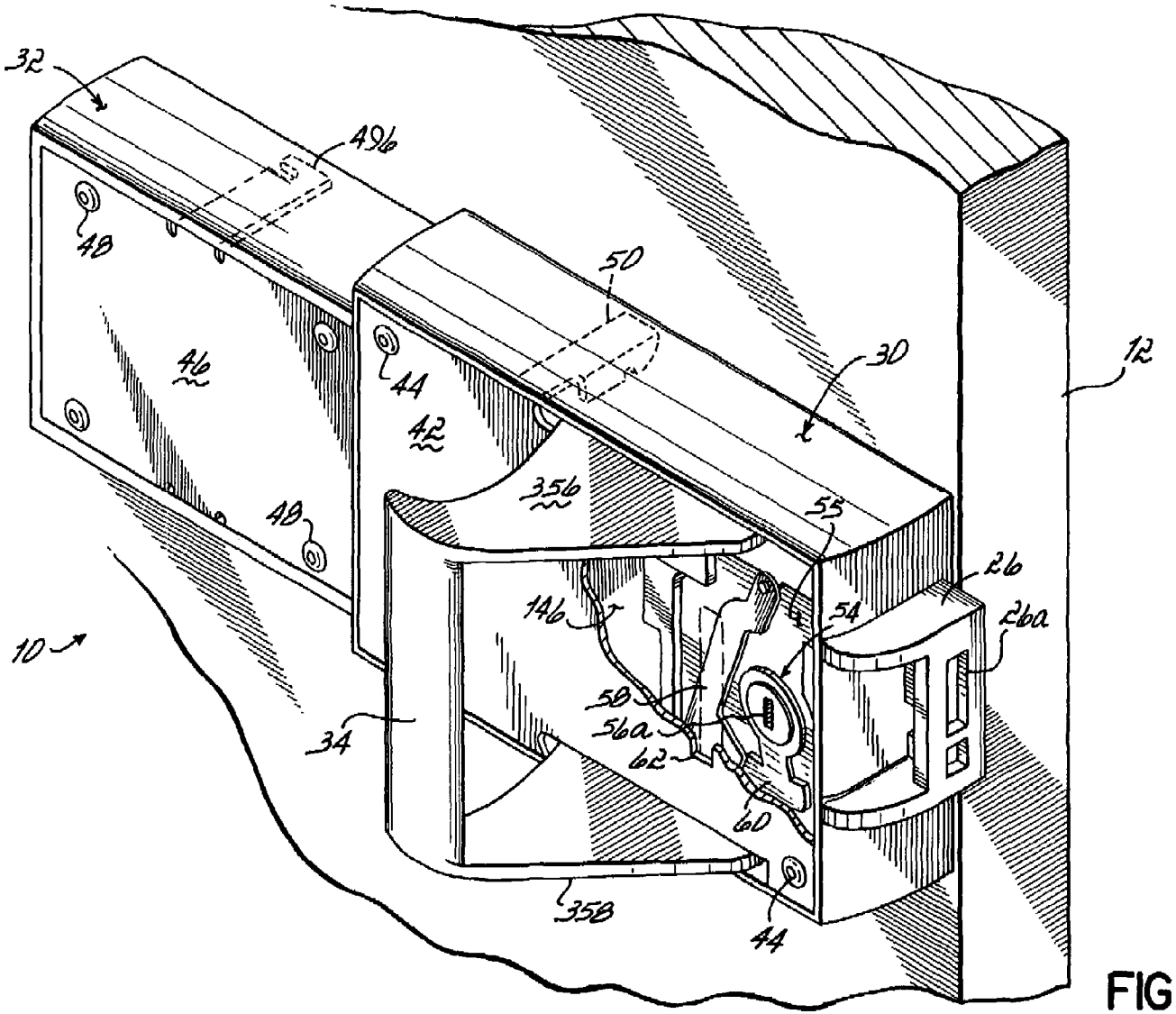
FIG. 2 is a perspective view of the lock system shown in FIG. 1, but showing the components as viewed from the inside of the door.
Figures 1, 3A:
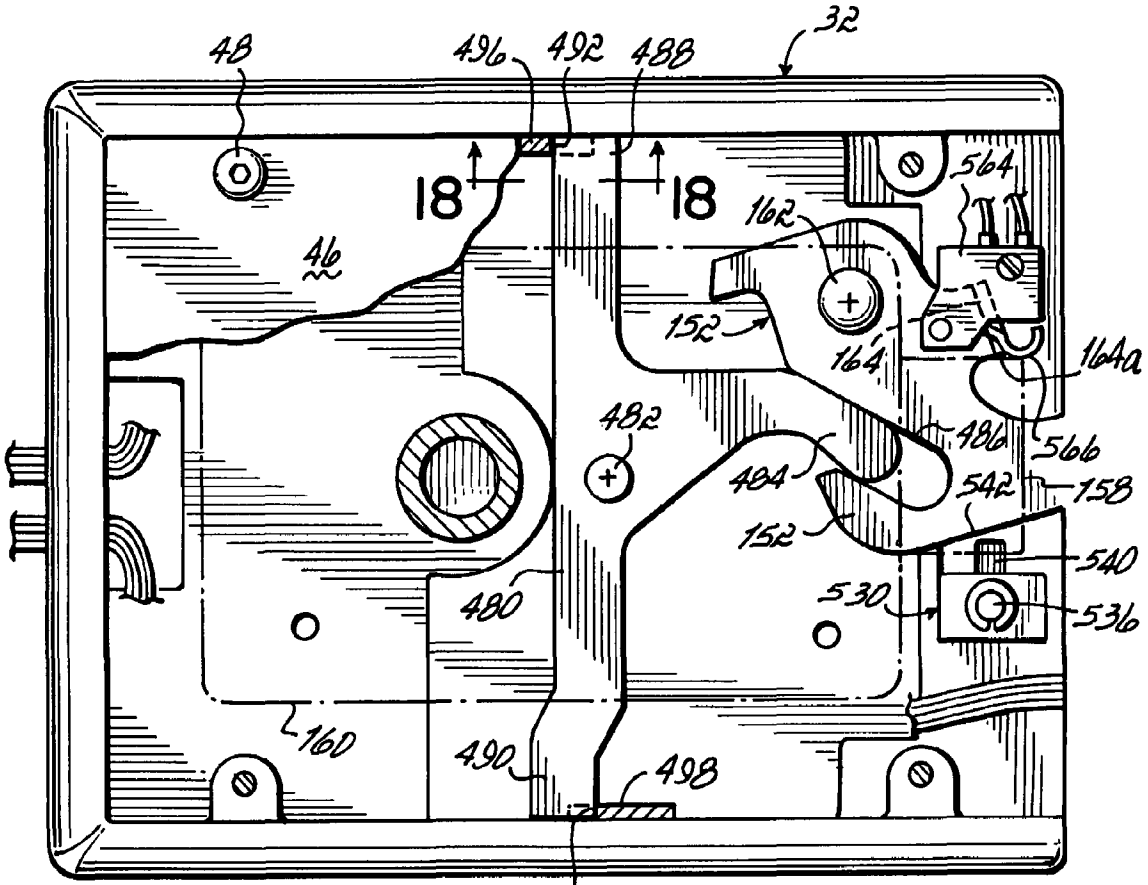
FIG. 3A, consisting of FIGS. 3A-1 and 3A-2, is an assembly view showing internal components of the housings with the dead bolt in an extended or actuated condition.
Figure 3A:
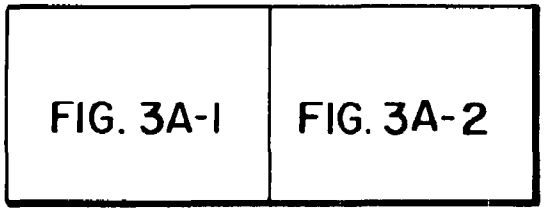
Figure 4A:
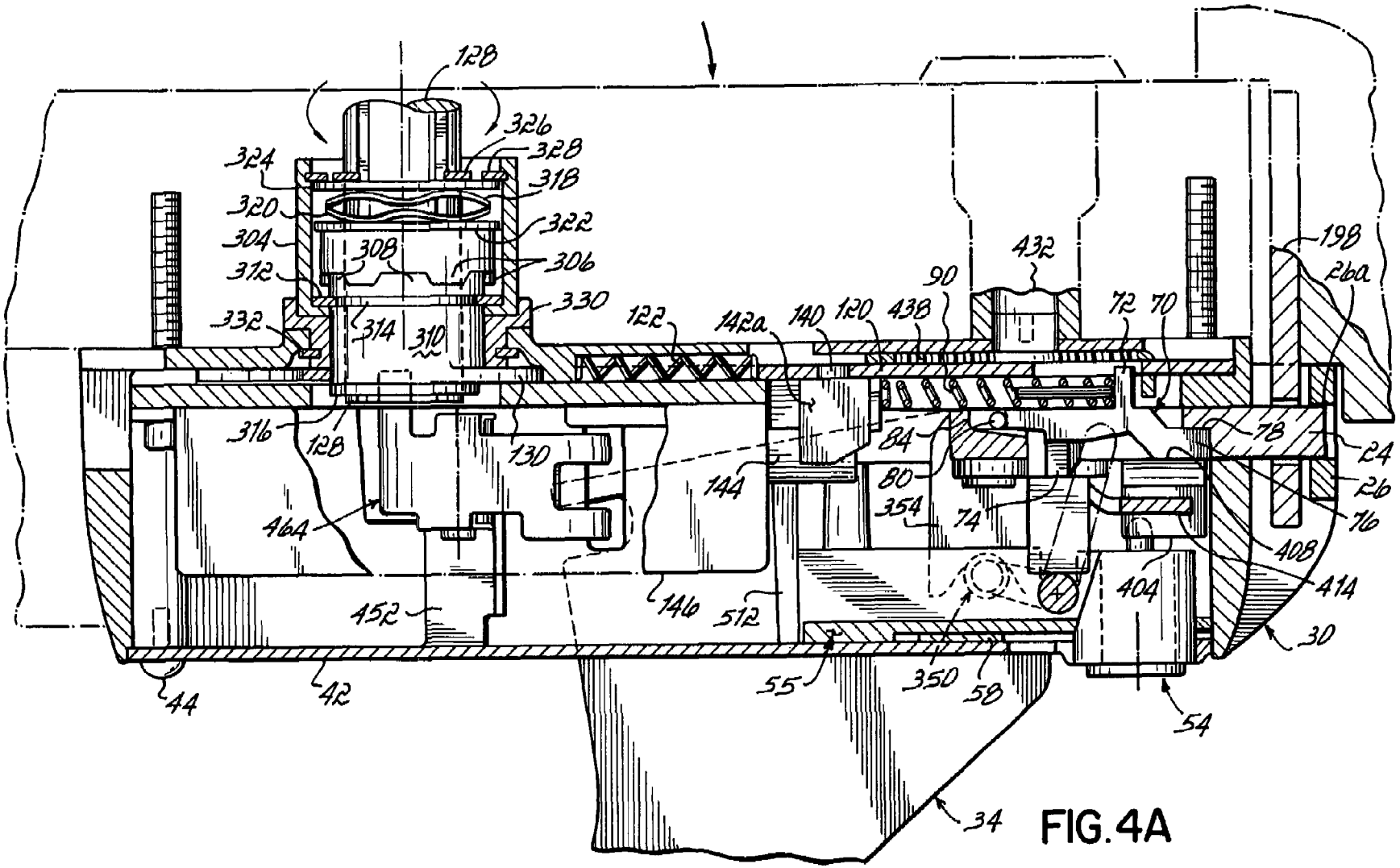
FIG. 4A is a cross sectional view taken generally along line 4A-4A of FIG. 3A.

Referring generally to FIGS. 1 and 2, a dead bolt lock system 10 constructed in accordance with one preferred embodiment of the invention is shown attached to a door 12. Lock system 10 includes a primary lock 14, which may be a high security electro-mechanical lock, and a secondary lock 16, which may be high security or a lower security electric combination lock. A door handle or lever 18 disposed on the outside of door 12 is shown connected just below secondary lock 16. An optional access control 20 and an optional override 22 are further shown as possible accessories to lock system 10. Once locks 14 and 16 have been unlocked by a user, and access control 20 has been successfully actuated by the user, the door handle 18 may be rotated up or down to withdraw a dead bolt 24, in a manner to be described, to gain access to a secure area behind door 12. It will be appreciated that access control 20 may also be considered a "lock" for purposes of this dead bolt system, in that it has a similar function to locks 14 and 16, as will be described. Override 22 is used, for example, to bypass both locks 14 and 16, and access control 20 to withdraw dead bolt 24. Override 22 also preferably bypasses the lock down feature, to be described below, in a manner allowing dead bolt 24 to be withdrawn. Dead bolt 24 is shown to be extendable and retractable within a bail 26 and bail 26 is adapted to receive a strike plate, as will be described below. As shown in FIGS. 3A and 4A, dead bolt 24 extends into a recess or hole 26*a* contained in a wall of bail 26 to prevent access to the end of bolt 24 during a forced entry attempt. As also shown in FIGS. 1 and 2, a trigger mechanism 28 is provided adjacent dead bolt 24 and assists in maintaining dead bolt 24 in a retracted position when system 10 is unlocked, and automatically extends dead bolt 24 when door 12 is shut, as described below.

Referring more specifically to FIG. 2, a pair of housings 30, 32 enclose components of locks 14, 16 and internal mechanical and electrical components of access control 20. Housings 30, 32 further contain actuating structure for dead bolt 24, as well as various other features to be described. It will be appreciated that housings 30, 32 may instead be combined into a single housing or other lock support structure. Lock 14 is specifically shown as a combination lock, such as disclosed in U.S. Pat. No. 5,064,923, using a dial 36 and an LCD display 38 for displaying combination numerals (FIG. 1). Secondary lock 16 is specifically shown as a combination lock featuring a number pad 40 for inputting a lock combination. It will be appreciated that many different types of locks may be substituted for locks 14 and 16. Moreover, although essentially three security locks are shown in the form of locks 14 and 16 and access control 20, access control 20 and lock 14 may be eliminated in various applications and any desired and suitable security lock may be used alone in the general manner described herein.

Figure 13:
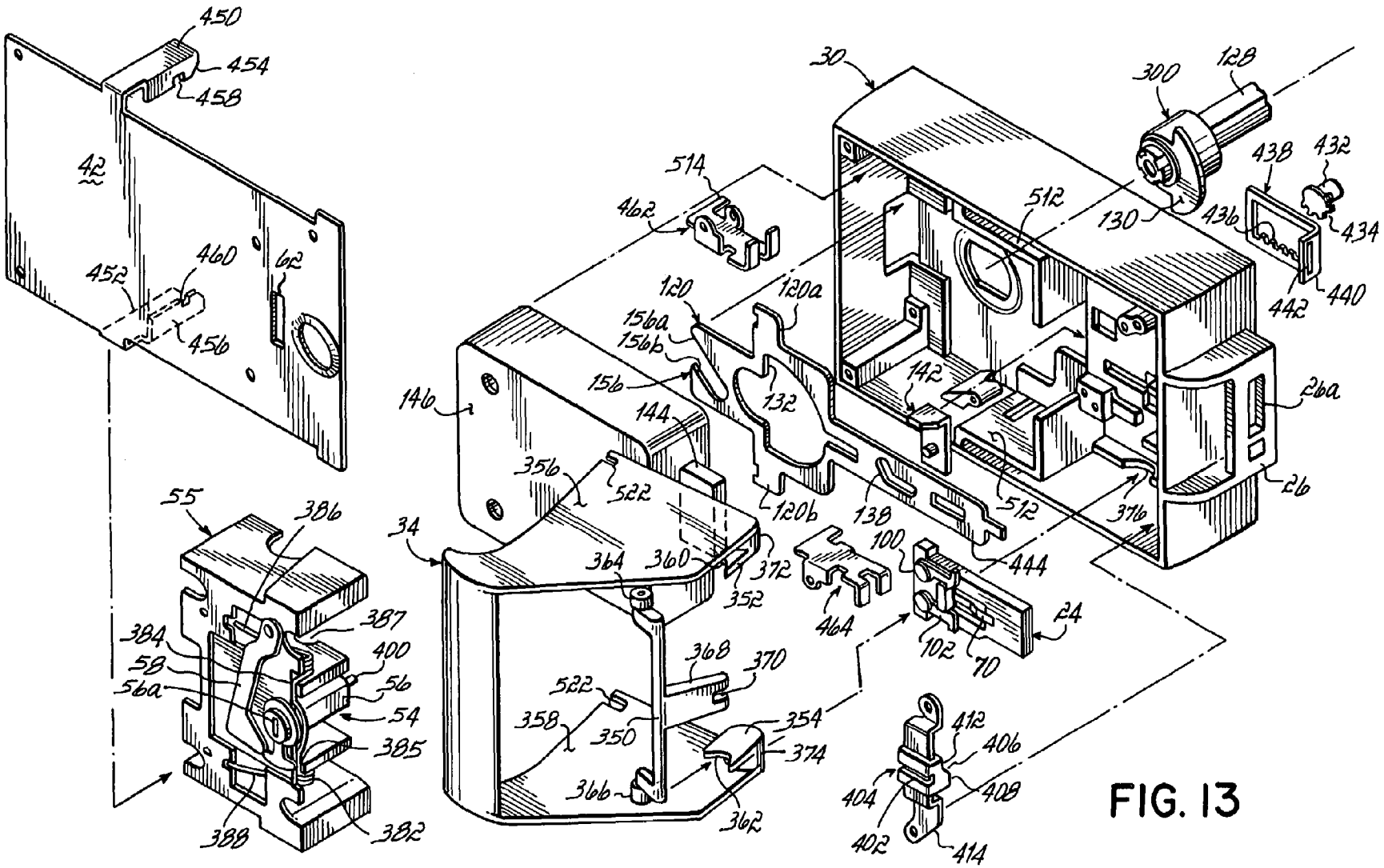
FIG. 13 is an exploded perspective view of the dead bolt lock housing and components.

Referring more specifically to FIG. 2, housing 30 includes a cover 42 fastened thereto by fasteners 44 and housing 32 includes a cover 46 fastened thereto by fasteners 48. Although described more specifically below, FIG. 2 also illustrates a night latch or lock down assembly 54 connected to a cap 55 mounted in housing 30. Although other actuating mechanisms may be used, night latch or lock down assembly 54 is preferably operated by a key inserted within a slot 56*a* in a rotatable cylinder 56 (FIG. 13). As will be described in detail below, this night latch or lock down assembly allows lock system 10 to be effectively shut down to prevent entry into the secure area. This is regardless of whether proper combinations or other unlocking information are input into locks 14, 16 and access control device 20. However, override 22 may still function when the night latch or lock down feature has been enabled. The lock down feature is useful when several doors 12 using lock system 10 are provided to access the same secure area. At night, it is useful to lock down all but one lock system 10 for providing more limited access to the secure area.

As also shown in FIGS. 2 and 13, a pivoting member 58 is connected to cap 55 adjacent key cylinder 56 for providing an indication of when the night latch or lock down feature is enabled. A tab 60 is mounted for rotation with key cylinder 56 and normally maintains pivoting member 58 out of alignment with a slot 62 in cover 42. Thus, for example, a plate behind pivoting member 58 may be colored green to indicate that the night latch or lock down feature is not enabled. However, when the key cylinder 56 is rotated 180 degrees with tab element 60 oriented upward, pivoting member 58 will fall into alignment with slot 62. Pivoting member 58 may be colored red, for example, to indicate to the user that the night latch feature has been enabled.

A general understanding of the main components used to extend and retract dead bolt 24 may be gained from a review of FIGS. 3A-B and 4A-B. FIGS. 3A and 4A respectively show dead bolt 24 in an extended position, while FIGS. 3B and 4B respectively show dead bolt 24 in a retracted position. Referring first to FIG. 4A, a dead bolt actuating member 70 is operatively coupled to dead bolt 24 to facilitate the extension and retraction thereof (see FIG. 5). Member 70 includes oppositely extending arms 72, 74 and includes a forward end 76 contained for sliding movement within a slot 78 in dead bolt 24. At the opposite end of actuating member 70, a pair of oppositely extending pins 80, 82 are retained for limited sliding movement within respective recesses 84, 86, as best shown ill FIG. 5. Another pin 88 extends lengthwise along actuating member 70 and is rigidly connected to arm 72. This pin retains a spring 90 which bears against arm 72 at one end and against a stationary support or stop 92 in housing 30 at the opposite end.

Figures 2, 3A:
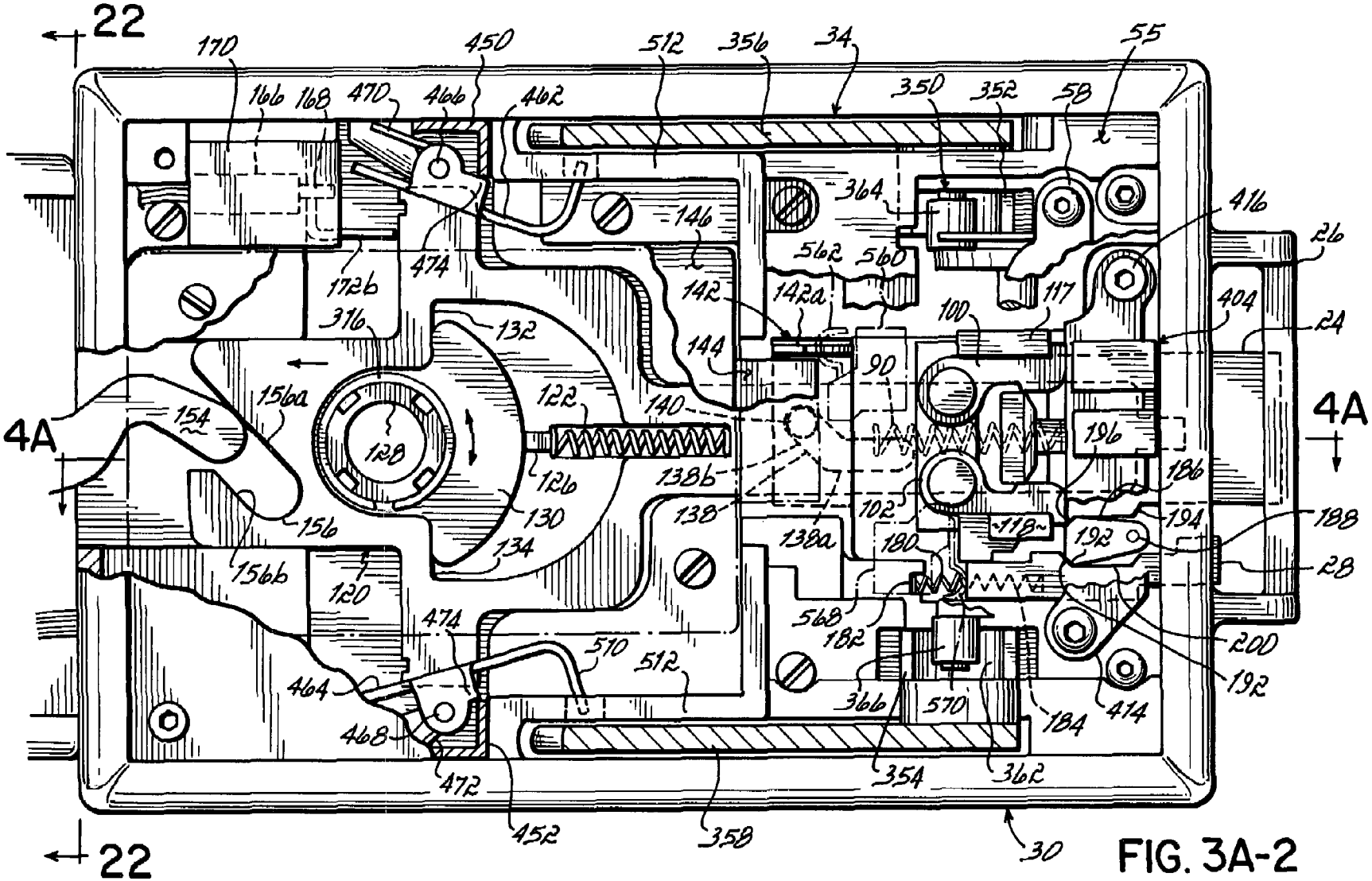
Figures 1, 3B:
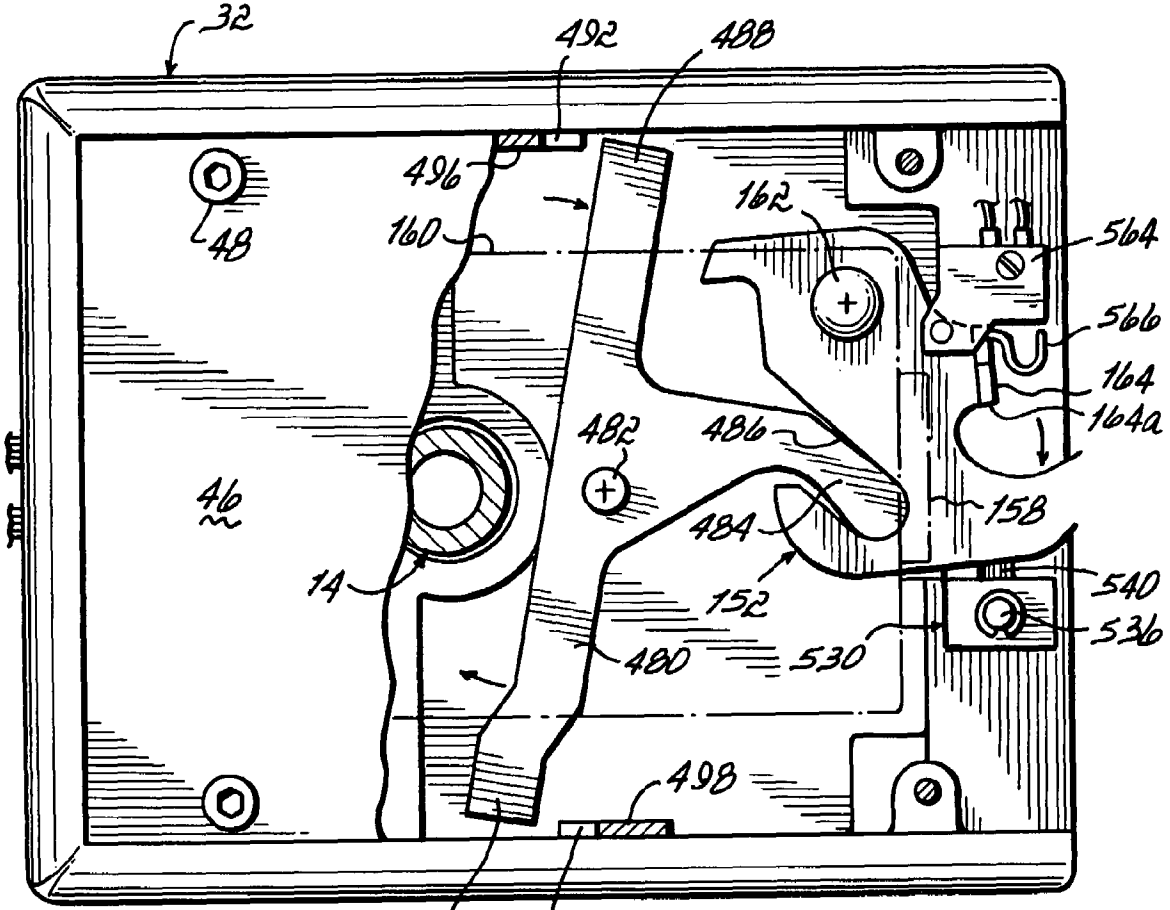
FIG. 3B, consisting of FIGS. 3B-1 and 3B-2, is an assembly view similar to FIG. 3A, but showing the dead bolt lock in a retracted condition.
Figure 3B:
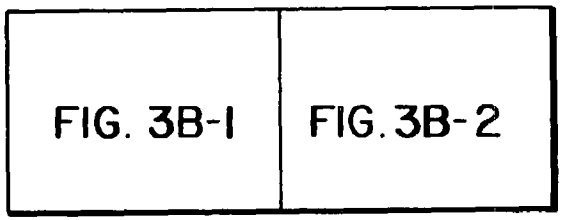
Figures 2, 3B:
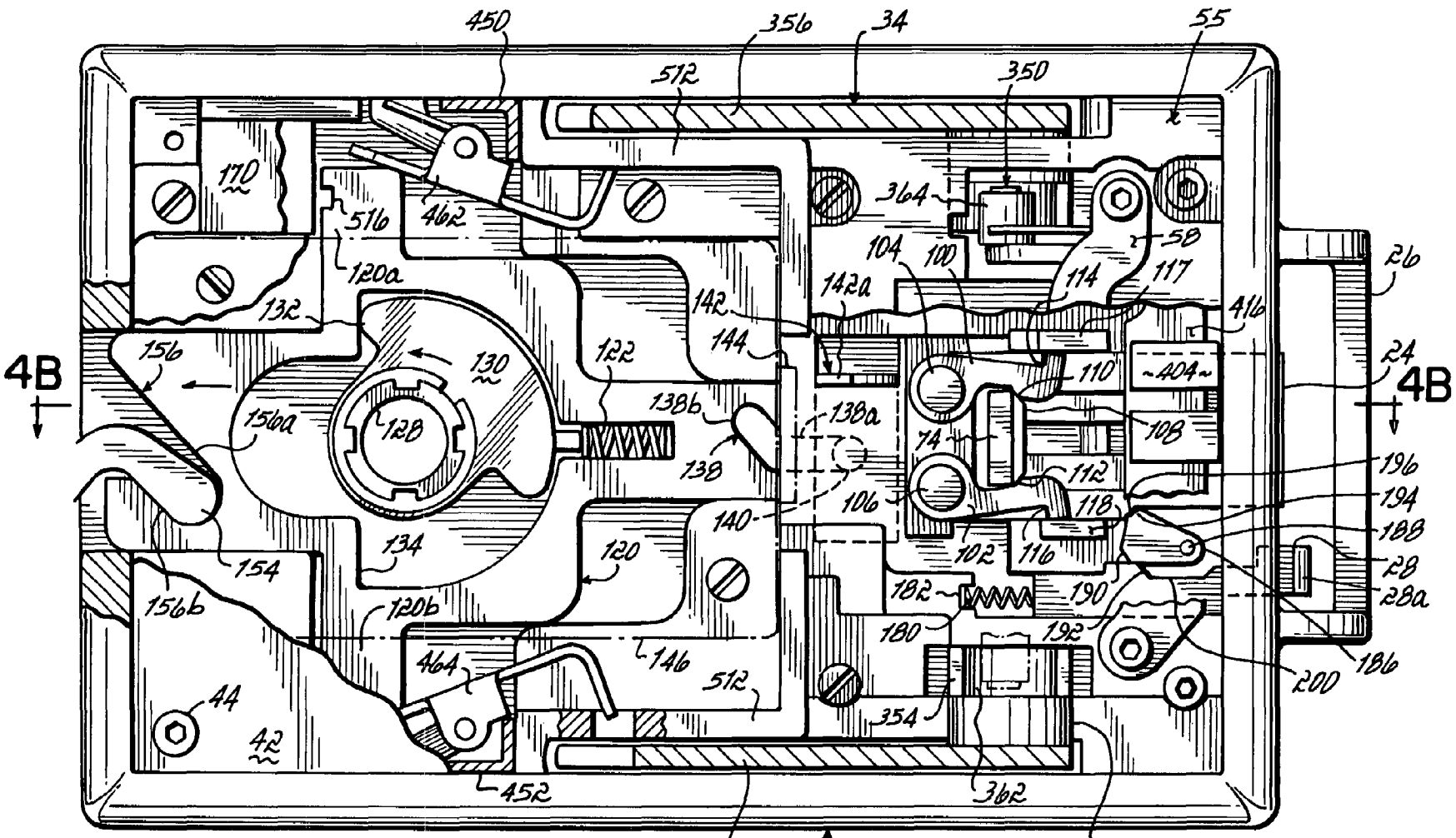
Figure 6:
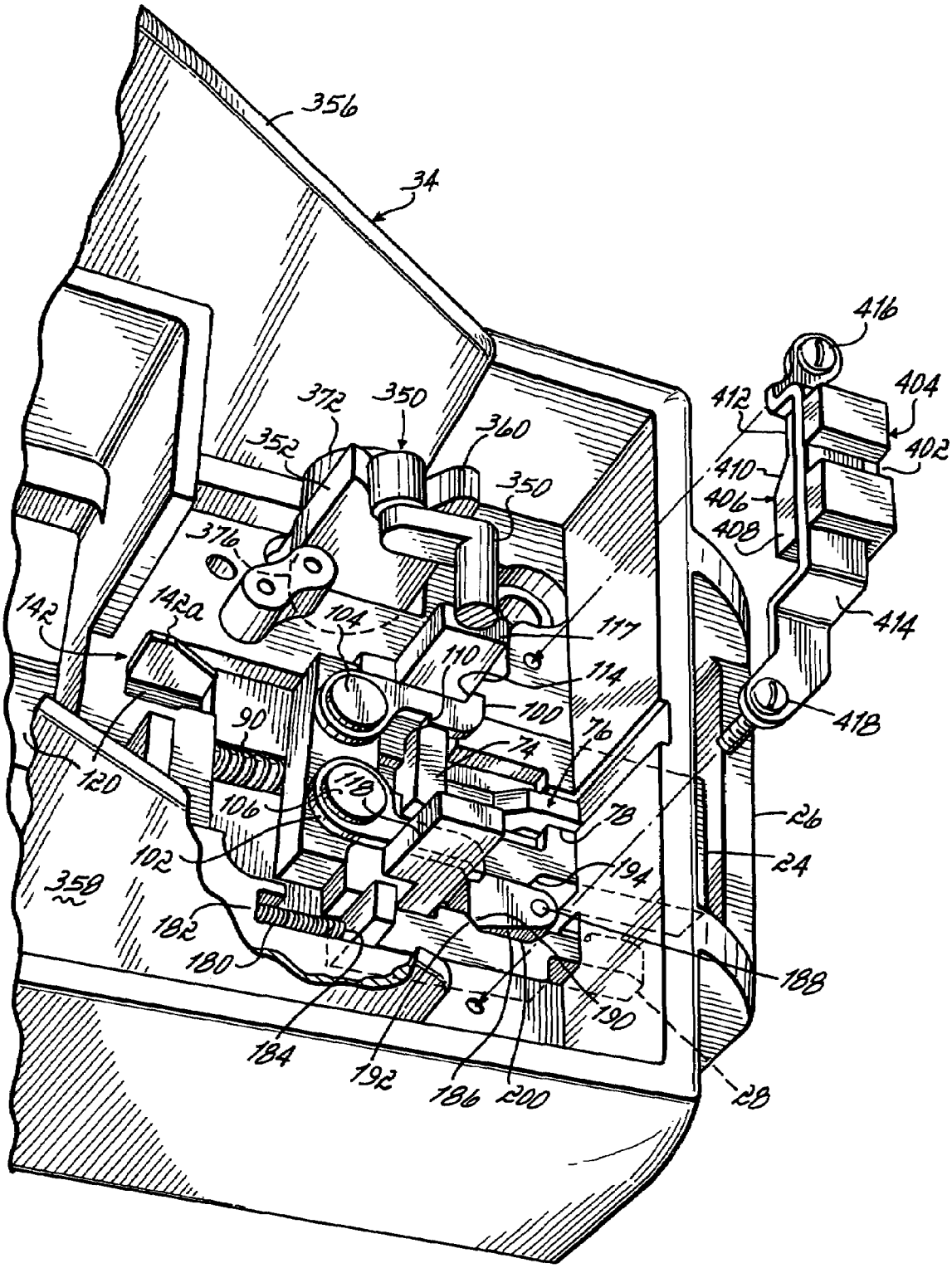
FIG. 6 is an enlarged perspective view, partially exploded and fragmented, to show certain components in the dead bolt lock housing.

Now referring to FIG. 3B and FIG. 6, a pair of pawls 100, 102 are connected to dead bolt 24 by pivots 104, 106. Arm 74 of actuating member 70 engages these pawls to facilitate a blocking feature of the preferred embodiment. Specifically, arm 74 includes a cam surface or beveled edge 108 in engagement with respective cam surfaces or edges 110, 112 on pawls 100, 102. Pawls 100, 102 have hook-shaped ends with retaining surfaces 114, 116. Surfaces 114, 116 also act as cam surfaces and engage stationary posts 117, 118 connected with housing 30 when dead bolt 24 is in the extended position, as shown in FIGS. 3A and 6. In this manner, any end pressure applied to dead bolt 24, as in an attempted forced entry, is received by stationary posts 117, 118 as opposed to the other inner working components of lock system 10.

Figures 4B, 4C:
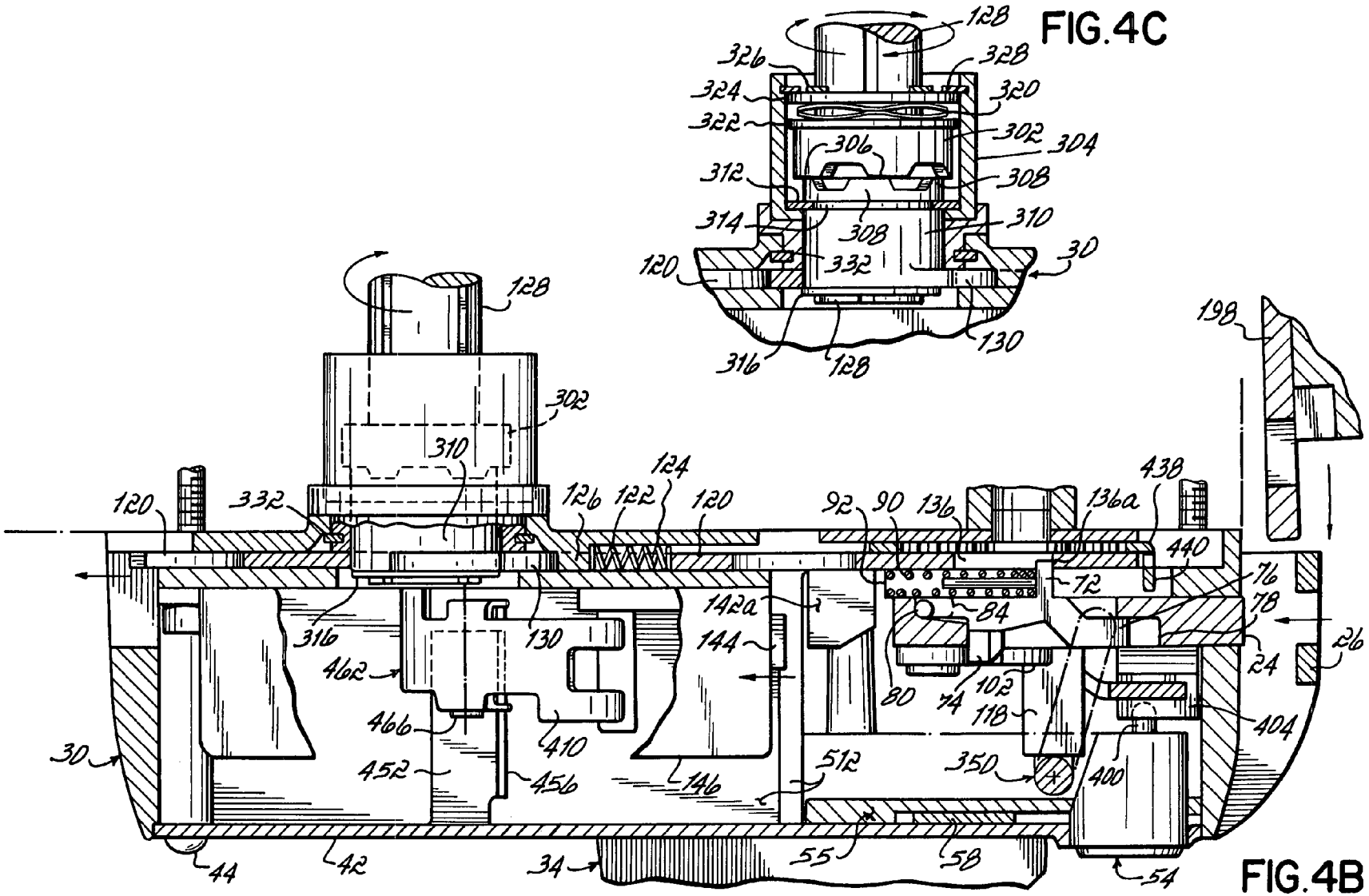
FIG. 4B is a cross sectional view generally taken along line 4B-4B of FIG. 3B.
FIG. 4C is a cross sectional view similar to FIGS. 4A and 4B showing operation of the torque override clutch mechanism.
Figure 5:
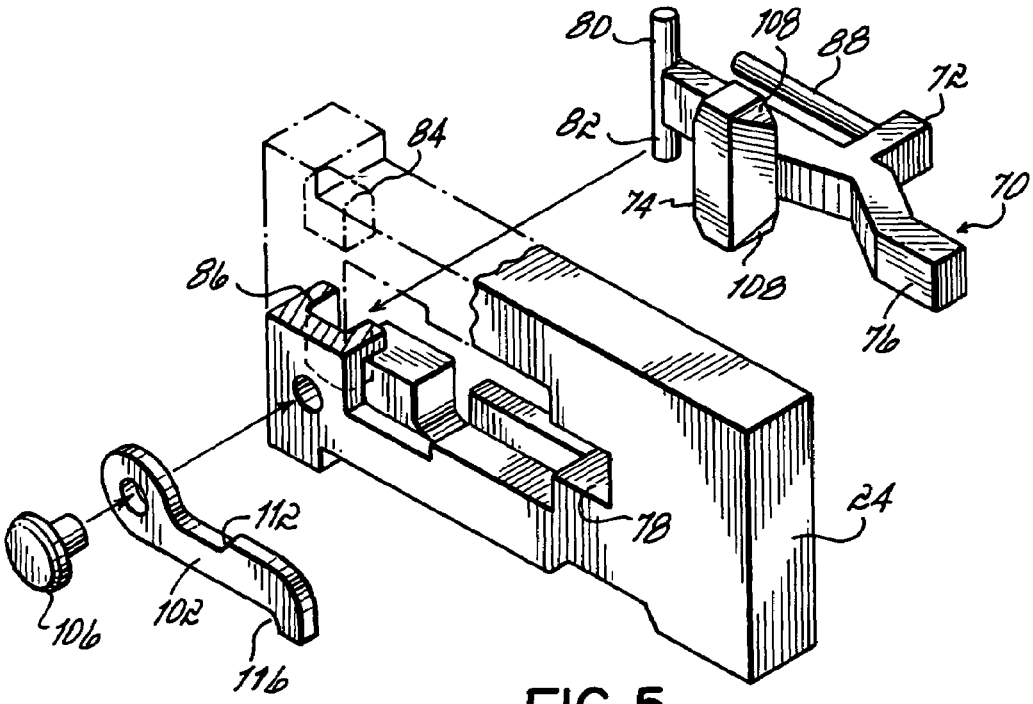
FIG. 5 is a disassemble perspective view showing various portions of the dead bolt system.

Referring now specifically to FIGS. 3A-B and 4A-B, a draw bar 120 is operatively coupled between dead bolt actuating member 70 and door handle 18 (FIG. 1). A spring 122 is provided to normally bias draw bar 120 toward dead bolt 24 and, therefore, normally bias dead bolt 24 into an extended position if other system components allow, as will be discussed herein. Spring 122 is contained within a slot 124 in draw bar 120 and against a stop surface or post 126 connected with housing 30. A shaft 128 operatively coupled for rotation with door handle 18 (FIG. 1), in a manner to be described, is connected to a cam 130. Thus, when shaft 128 rotates in either direction, cam 130 engages either surface 132 or surface 134 of draw bar 120 to move or retract draw bar 120 to the left as viewed in FIGS. 3A and 3B, if other components of system 10 allow such movement. Draw bar 120 is connected to dead bolt actuating member 70 through the receipt of arm 72 within a slot 136, as best shown in FIGS. 4A and 4B. Specifically, when draw bar 120 is moved to the left as viewed in FIGS. 4A and 4B, an end 136*a* of slot 136 will pull against arm 72 and thereby draw dead bolt actuating member 70 to the left as pins 80, 82 engage the left ends of recesses 84, 86 within dead bolt 24.

As will be discussed herein, several conditions must be met in the preferred embodiment for the above described retraction of dead bolt 24 to take place. Assuming for now that the optional access control 20 is not a part of lock system 10, the main conditions for retracting dead bolt 24 with door handle 18 in the general manner described above are that locks 14 and 16 must be in unlocked conditions. Referring to FIG. 3A, draw bar 120 is provided with a slot 138 which receives a pin 140 connected with a test member specifically in the form of a lever 142. Although the preferred test members are referred to herein as levers, it will be appreciated that the test members may take various forms within the spirit and scope of the invention. Various test members may be substituted for the mechanical levers disclosed herein, including both mechanical and electrical components. In the latter regard, it will be appreciated from the description to follow that the test levers may be substituted with sensors or switches disposed adjacent a lock which then react appropriately to the lock condition to allow or prevent retraction of the dead bolt structure.

Still referring to FIGS. 3A and 3B, slot 138 includes a horizontal portion 138*a* and an angled portion 138*b*. Test lever 142 includes an angled or flange portion 142*a* at an upper end thereof. This flange portion 142*a* rests on top of a lock bolt 144 of lock 16, i.e., when lock 16 is in a locked condition. It will be appreciated that lock 16 includes a casing 146 which may have a standard footprint or size such that the extended lock bolt 144 will always occupy the same space in accordance with the particular footprint. It will further be appreciated that draw bar 120 will not be capable of moving to the left, as viewed in FIG. 3A, to retract dead bolt 24 if lock bolt 144 is in an extended and locked condition. This is because pin 140 connected with test lever 142 will bear against angled slot portion 138*b* and, although test lever 142 will attempt to move downwardly, it will be stopped by lock bolt 144. If, on the other hand, lock bolt 144 is either retracted due to an unlocked condition or able to be pushed into casing 146 due to an unlocked condition, test lever 142 and pin 140 will move downward when draw bar 120 is moved to the left to retract dead bolt 24. To continue the leftward movement or retraction of draw bar 120, pin 140 will ride within horizontal slot portion 138*a* as shown in FIG. 3B.

Assuming that lock 14 is connected as part of system 10 as shown in FIG. 1, another condition must be met in order to retract draw bar 120 and, therefore, dead bolt 24. In this regard, as shown in FIGS. 3A and 3B, another test lever 152 is provided with an end 154 received for movement within a slot 156 of draw bar 120. As also shown in FIG. 3A, lock 14 includes a lock bolt 158 shown extended from a lock casing 160 mounted within housing 32. Lock bolt 158 is in a locked condition and, again, casing 160 preferably has a standard footprint such that the extended lock bolt 158 occupies a predetermined space. Test lever 152 is connected by a pivot 162 to housing 32 and includes a flange or tab portion 164 which normally rests on top of lock bolt 158. In this position, it will be appreciated from FIG. 3A that draw bar 120 will not be capable of moving to the left to retract dead bolt 24 due to the presence of end 154 and the inability of test lever 152 to pivot downwardly due to the obstruction by lock bolt 158. If, on the other hand, lock bolt 158 is in an unlocked condition, and either not present beneath tab portion 164 as shown in FIG. 3B or capable of being moved inwardly, for example, as various swing bolts may be designed to operate, test lever 152 will pivot downwardly and end 154 will be received within slot 156 as draw bar 120 is moved to the left. Specifically, as handle 18 (FIG. 1) is turned, cam 130 will move draw bar 120 to the left and cam surface 156*a* will force end 154 of lever 152 into slot 156. Tab portion 164 includes a lower edge 164*a* which engages lock bolt 158 if bolt 158 is extended from casing 160. If bolt 158 is in a locked condition, this will prevent retraction of draw bar 120. Test lever 152 will be moved upwardly or in a counterclockwise direction by the engagement of cam surface 156*b* with lever end 154 as draw bar 120 moves back to the right.

Now referring to FIG. 1 in conjunction with FIGS. 3A and 3B, access control 20 may provide another lock condition that must be met in lock system 10 before retraction of draw bar 120 and dead bolt 24 can take place by turning door handle 18. Access control 20 is shown as a card reading device, however, this card reading device may be many different devices designed to provide various levels of security by requiring various input information. For example, card reading device 20 may be substituted simply with one or more push buttons or switches, retinal scans, fingerprint identifiers, voice identifiers, etc. In the preferred embodiment, it may be useful to maintain locks 14 and 16 in an unlocked condition at times of high traffic through door 12. This would simply require employees or other users of door 12 to use access control device 20 to allow entry through door 12. On the other hand, it may be useful to only maintain high security lock 14 in an unlocked condition during such times and require users of door 12 to input in the correct combination to open lock 16 and also to properly activate access control device 20 to open door 12 with handle 18.

Internal Access Control

Figure 7:
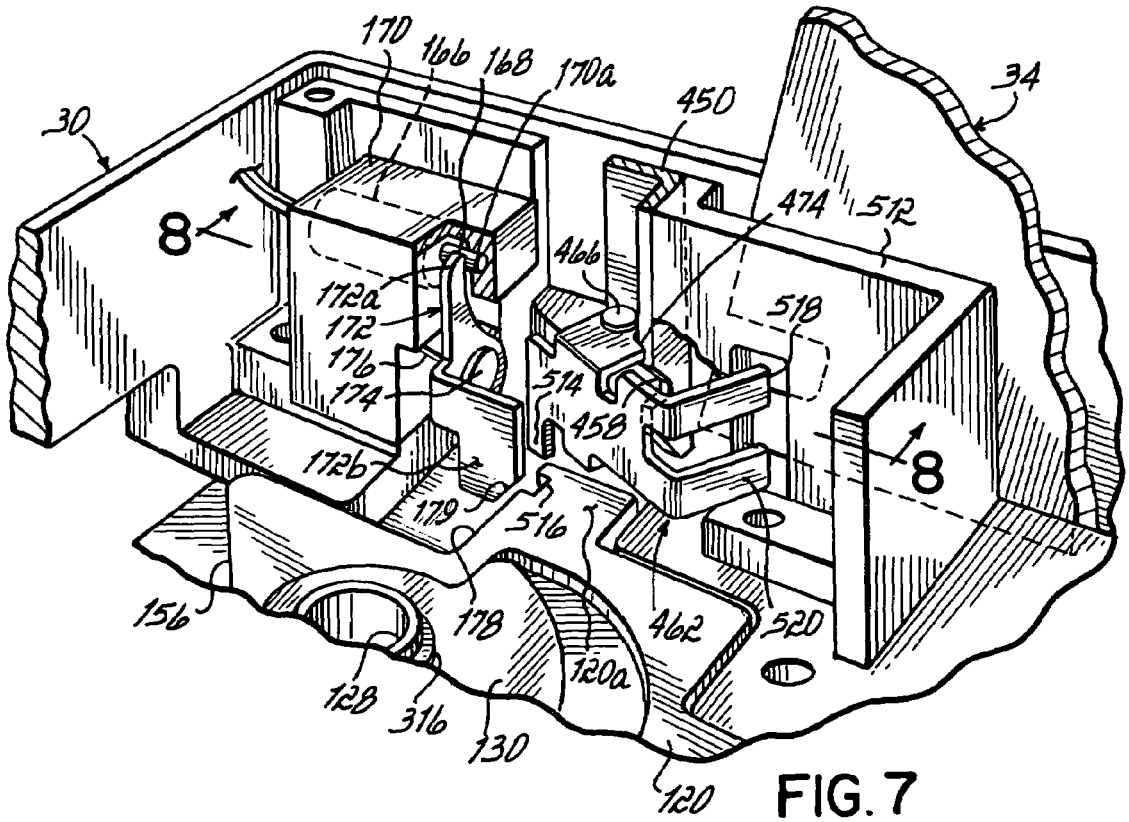
FIG. 7 is an enlarged perspective view of an optional access control portion of the system.
Figure 8:
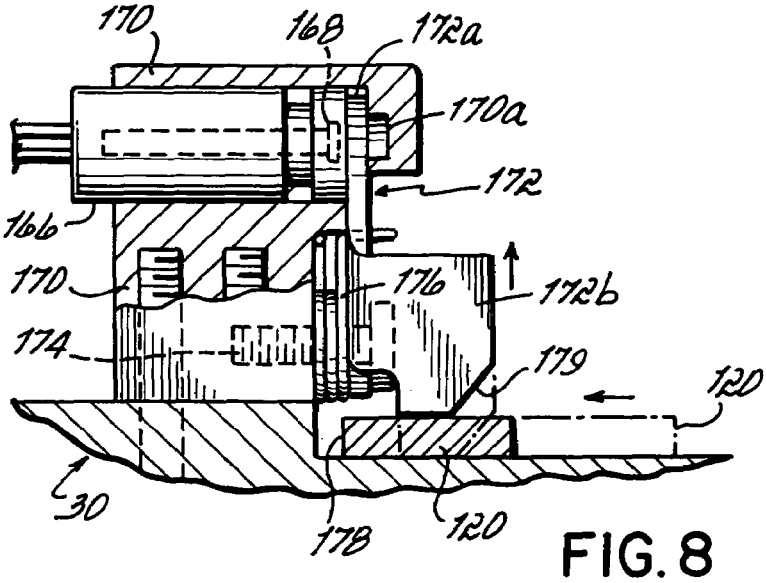
FIG. 8 is a cross sectional view taken along line 8-8 of FIG. 7.

As best shown in FIGS. 7 and 8, access control device 20 can specifically operate a solenoid 166 which, in the preferred embodiment, may be contained within housing 30. Solenoid 166 is preferably electromagnetically operated and includes a movable reciprocating member or piston 168 which is normally in the extended position shown in FIG. 7. Solenoid 166 and piston 168 are contained within a support 170. With piston 168 in the extended position shown in FIG. 7, it is supported by a recessed surface 170*a*. In this way piston 168 is prevented from receiving excessive side load from portion 172*a* of test lever 172, as will be described. Test lever 172 is connected to support 170 at a central pivot 174 and is biased in a counterclockwise direction by a spring 176. Another portion 172*b* of test lever 172 interacts with an edge 178 of draw bar 120. Specifically, edge 178 engages a cam surface 179 on portion 172*b* when draw bar 120 is retracted by cam 130. With piston 168 in its normally extended position as shown in FIG. 7, rotation of test lever 172 in a clockwise direction will be blocked and, therefore, draw bar 120 will not be capable of retraction. However, as shown in FIG. 8, when access control device 20 is properly activated, as by sliding an appropriate card through the card reading slot thereof (FIG. 1), solenoid 166 will be actuated to retract piston 168. This will allow draw bar 120 to move to the left as test lever 172 rotates in a clockwise direction against the bias of spring 176 and through the interaction of edge 178 with cam surface 179. Therefore, in this case, assuming all other lock conditions are met as described herein, draw bar 120 may be retracted by rotating door handle 18 to thereby retract dead bolt 24 (FIG. 1).

Dead Bolt Hold Back Mechanism

Lock system 10 further includes a dead bolt hold back feature as best shown in FIGS. 3A-B and 6. This feature is designed to hold dead bolt 24 in a retracted position while door 12 is open and is operated by trigger 28 as generally mentioned above. More specifically, trigger member 28 is an elongate member which extends from housing 30 into bail 26 at one end and is biased by a compression spring 180 at the opposite end. Spring 180 is restrained by a stationary stop 182 associated with housing 30 and within a blind hole 184 contained in trigger member 28. A pivoting hold back element 186 is connected by a pivot 188 to a suitable portion of housing 30, for example, and includes a cam surface 190 which engages a cam surface 192 on trigger member 28. This holds trigger member 28 in an inward position against the bias of spring 180, as shown in FIG. 3A, with dead bolt 24 extended. However, when dead bolt 24 is retracted, as described above and shown in FIG. 3B, hold back element 186 will be forced to pivot upwardly through the interaction of cam surfaces 190, 192 and the force of spring 180 as another cam surface 194 contained on the undersurface of dead bolt 24 reaches an upper cam surface 196 of pivotal hold back element 186.

As further shown in FIG. 3B, hold back element 186 will be held firmly between dead bolt 24 and an upper surface of trigger member 28 with cam surfaces 194, 196 interacting to retain dead bolt 24 in the retracted position against the bias of spring 122. In this position, trigger element 28 partially extends into bail 26. When door 12 is closed and a strike plate 198 enters bail 26, as shown in FIG. 4A, an exposed cam surface 28*a* of trigger member 28 will be engaged by strike plate 198. This will push trigger member 28 to the left, as viewed in FIG. 3A and cause hold back element 186 to drop into recess 200. At the same time, dead bolt 24 will extend through strike plate 198 and into space 26*a*. Trigger member 28 will again be held in its retracted position until dead bolt 24 is retracted again.

External Access Control

Figure 9B:
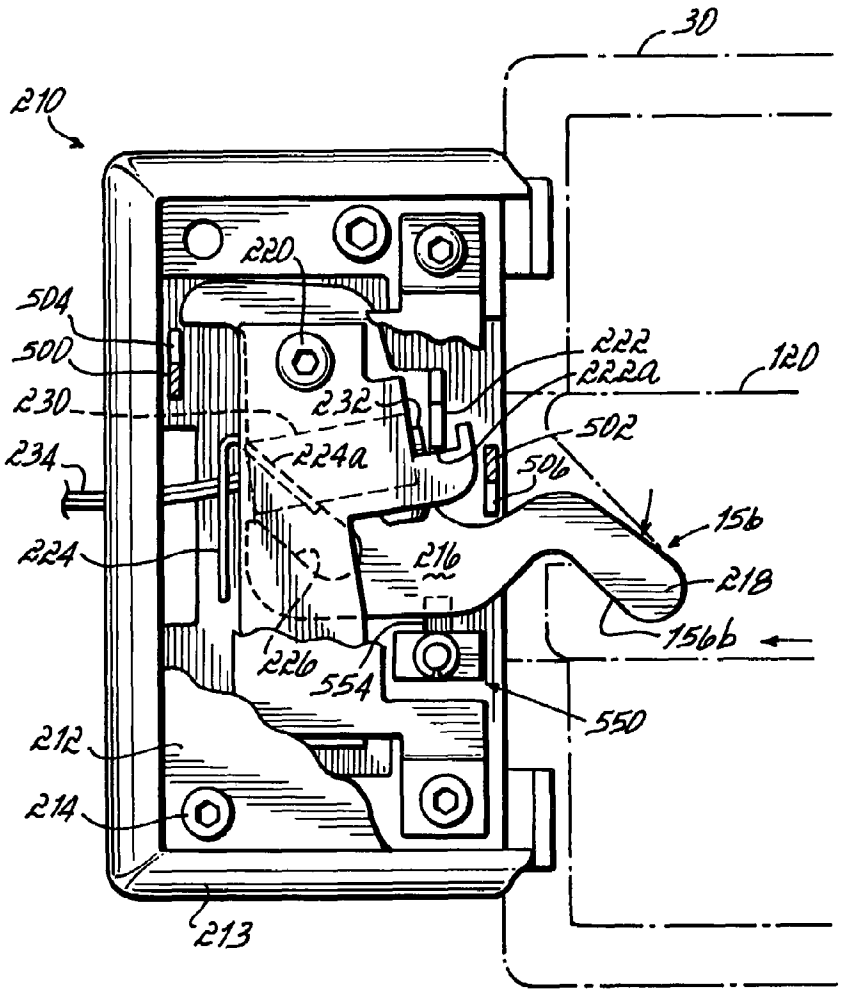
FIG. 9B is a view similar to FIG. 9A but showing the access control device in an actuated condition.
Figure 9A:
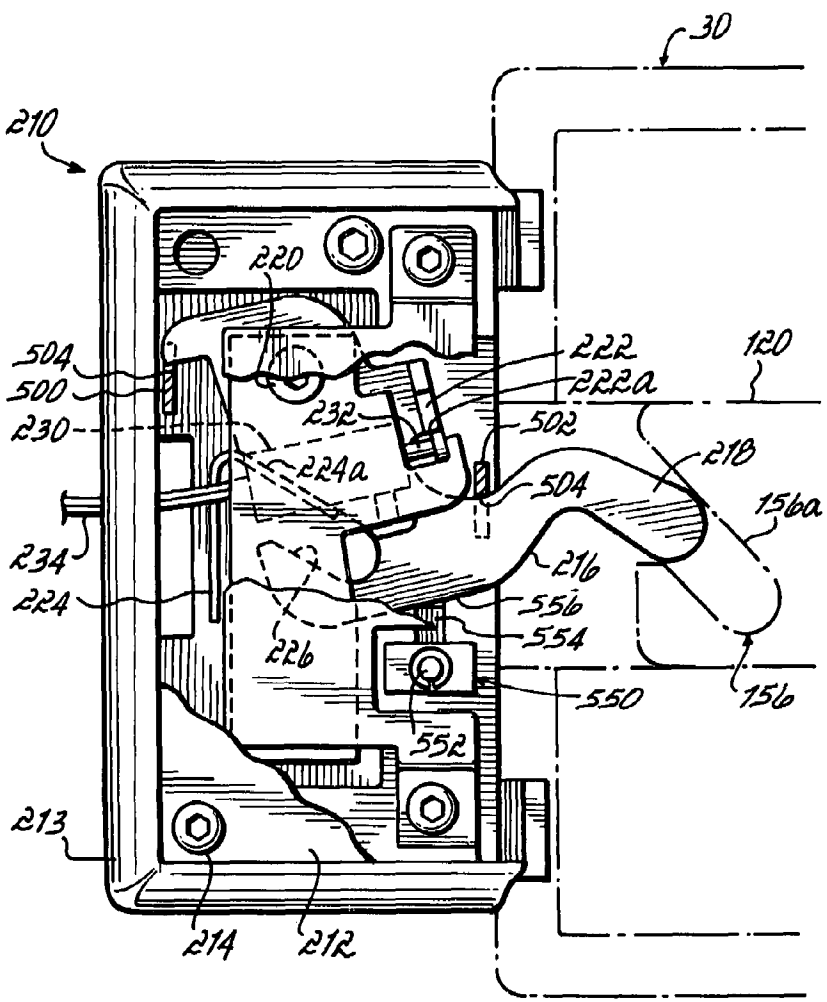
FIG. 9A is an elevated plan view, partially fragmented to show the internal components of an optional access control device.

FIGS. 9A and 9B illustrate an optional access control device 210 shown affixed to housing 30 in place of housing 32 (FIG. 1). While many configurations are possible, it will be understood that access control 210 may serve as a replacement for security lock 14, while retaining security lock 16 and optionally retaining internal access control 20. Alternatively, high security lock 14 may be substituted for lower security lock 16 so that lock system 10 still has both a high security and a lower security locking or access control device, for purposes as generally described above. Of course, many other configurations are also within the scope of this invention.

Specifically referring to FIG. 9A, access control device 210 is shown in a locked condition, with the same general result as described above with respect to security lock 14 as shown in FIG. 3A. FIG. 9A illustrates access control device 210 having a lid 212 fastened to a housing 213 by fasteners 214, and partially broken away to show internal working components of device 210. Device 210 more specifically includes a test lever 216 having an end or portion 218 and pivoting about a pivot 220 within housing 213. Test lever 216 further includes a tab portion 222 with a lower edge 222*a*. Test lever 216 is further affixed within housing 213 by a spring 224 having a portion retained within a slot 226. An electromagnetically operated solenoid 230 having a reciprocating member 232 is further mounted within housing 213 and connected to an appropriate control by wiring 234. As will be understood from a review of FIG. 9A, reciprocating member 232 of solenoid 230 is normally maintained in an extended position in engagement with edge 222*a* to block downward movement of tab portion 222 and therefore also block downward pivoting motion of test lever portion 222 about pivot 220. Therefore, in the normally locked position shown, test lever portion 218 will prevent retraction of draw bar 120 to the left, as viewed in FIG. 9A, through the engagement of test lever portion 218 with wall 156*a* of slot 156 in draw bar 120.

When reciprocating member 232 of solenoid 230 is retracted, as shown in FIG. 9B, downward pivoting motion of test lever 216 will be allowed against the bias of spring 224. Solenoid 230 may be actuated, for example, by a card reading device, such as the type shown in FIG. 1 for access control 20, or by other appropriate controls such as a retinal scan, fingerprint identifier, voice identifier, a push button or series of push buttons. Once solenoid 230 is actuated with appropriate input information, draw bar 120 may be retracted, assuming any other security locks associated with system 10 are also in unlocked conditions, and test lever 216 will pivot or rotate clockwise as shown in FIG. 9B so that test lever portion or end 218 is received within slot 156 as draw bar 120 moves to the left. Solenoid 230 may be controlled to deactivate, and therefore extend reciprocating member 232, after a predetermined amount of time. Thus, when draw bar 120 is again moved to the right to extend dead bolt 24 (FIG. 3B), test lever 216 will rotate counterclockwise under the influence of spring 224. Access control device 210 will then be again retained in its normally locked condition as shown in FIG. 9A.

Torque Override Clutch Mechanism

Figure 11:
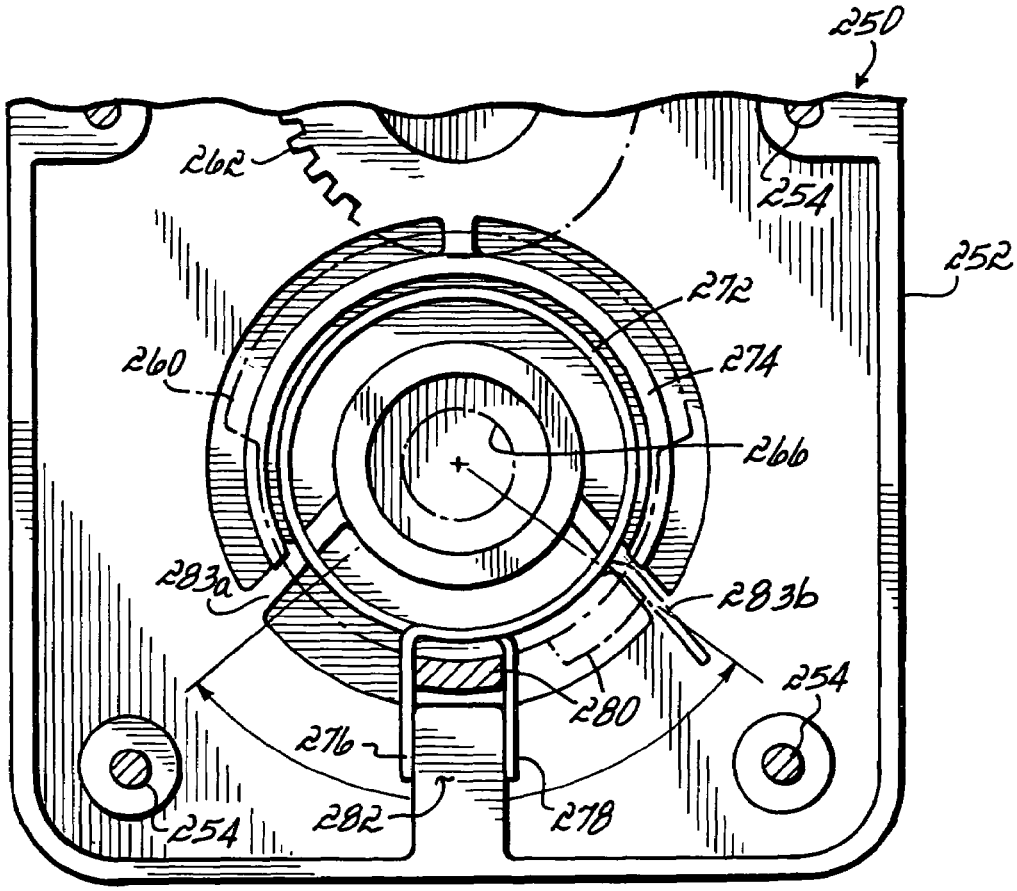
FIG. 11 is a view generally taken along line 11-11 of FIG. 10, but showing the interaction between a spring and gear used to maintain the door handle in a predetermined position.
Figure 10:
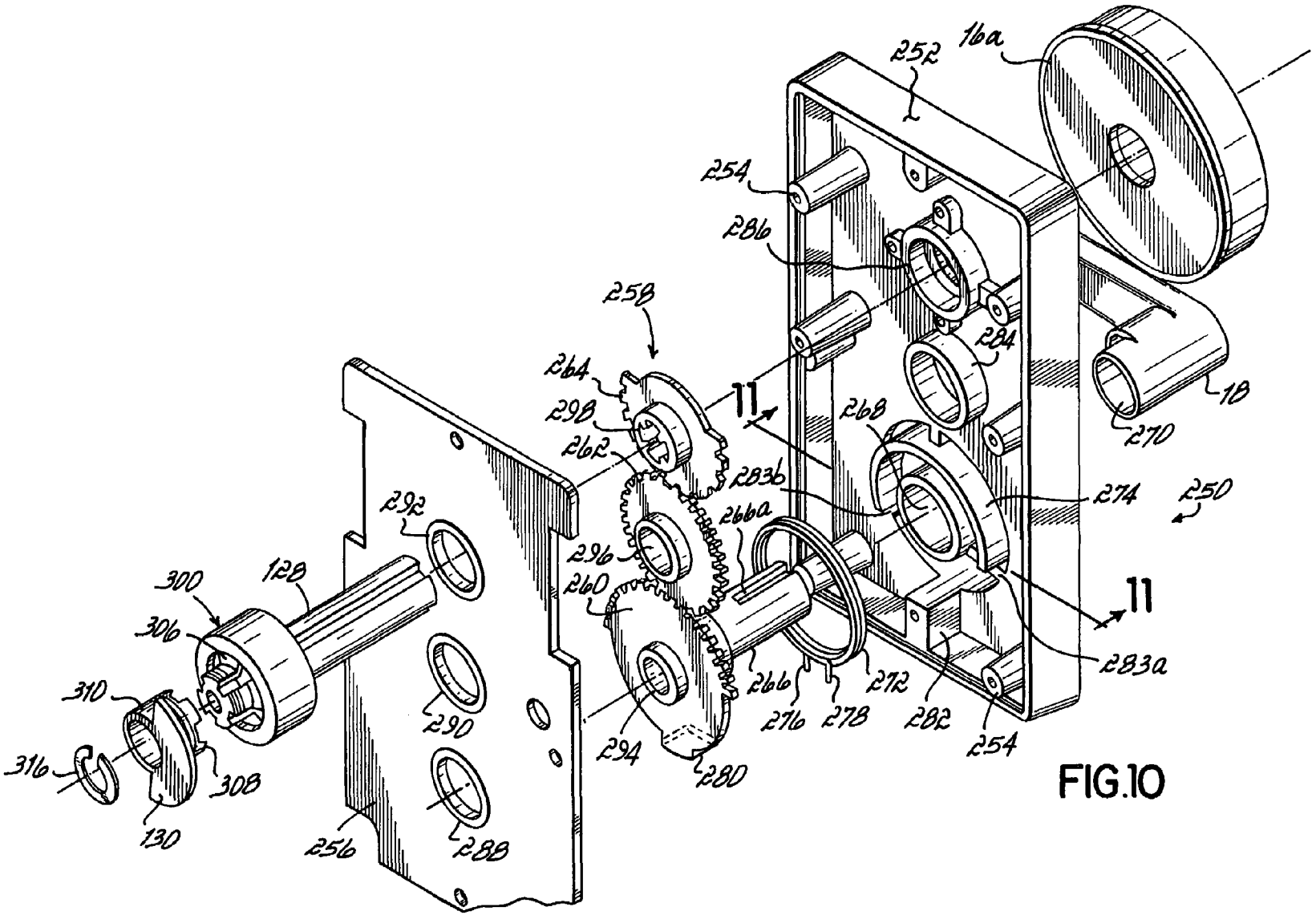
FIG. 10 is an exploded perspective view of the door operating lever or handle and the gear train and clutch mechanism used to connect the handle to the dead bolt lock system.

Turning now to FIGS. 10 and 11, a handle actuating assembly 250 is provided for allowing a user to open door 12 by rotating handle 18 in either a clockwise or counterclockwise direction to retract dead bolt 24 when all other lock conditions have been met. Essentially, rotation of handle 18 is ultimately transferred to cam 130 to operate draw bar 120 as previously described. As shown in FIG. 10, handle actuating assembly 250 includes a front cover 252 having fastening posts 254 that may receive fasteners (not shown) extending through door 12 (FIG. 1). A rear plate 256 is preferably used to retain the various components of actuating assembly 250 within cover 252. These components mainly comprise a gear train 258 including an input gear 260 operatively connected to door handle 18 and engaging an idler gear 262 which, in turn, engages an output gear 264. A shaft 266 extends from input gear 260 and includes a keyway used with a key (not shown) to connected input gear 260 for rotation with a hollow portion 270 of door handle 18. A coil spring 272 is retained about a support member 274 and includes two ends 276, 278 which are retained on either side of a tab 280 connected with input gear 260.

As best shown in FIG. 11, spring ends 276, 278 are disposed on respective sides of a stationary stop member 282 provided within cover 252. Thus, it will be appreciated that door handle 18 is spring biased into a neutral position and, when rotated in opposite directions, one or the other of spring ends 276, 278 will move with tab 280 and input gear 260 while the other spring end will be retained in place by stop member 282. Rotation of handle 18 may take place until tab 280 hits either of two stops 283*a*, 283*b* in housing 250. When door handle 18 is released, spring 272 will bias input gear 260 and, specifically, tab 280 to the neutral position shown in FIG. 11. In addition to the rotational support member 268, similar support members 284, 286 are respectively provided in cover 252 for idler gear 262 and output gear 264. Each of these gears 262, 264 includes a tubular extension (not shown) received by supports 284, 286. Likewise, cover 256 includes rotational support members 288, 290, 292 for respective mounting portions 294, 296, 298 of gears 260, 262, 264 to allow rotation thereof.

Turning now more specifically to FIGS. 4A and 4C, taken generally in conjunction with FIG. 10, a torque override clutch assembly 300 is provided to ensure that if lock system 10 is in a locked condition, an excessive amount of torque may not be applied to door handle 18. This serves to protect the various inner working components of system 10. Specifically, as shown in FIG. 4A, torque override clutch assembly 300 includes a movable torque sensor 302 contained for rotational movement with splined shaft 128 and translational movement along splined shaft 128 within a cylindrical housing member 304. Torque sensor 302 includes a plurality of teeth or cam elements 306 that engage corresponding teeth or cam elements 308 disposed on a tubular mounting portion 310 of cam 130. A retaining ring 312 retained in a groove 314 is used to retain tubular mounting portion 310 and cam 130 in the position shown in FIG. 4A. A retaining clip 316 attaches cam 130 and its mounting portion 310 to shaft 128. A pair of annular compression spring plates 318, 320 are disposed about shaft 128 and retained between a pair of washers 322, 324. Other spring arrangements may be used as well. One retaining ring 326 is connected around shaft 128 and one retaining ring 328 is connected to the interior of housing 304 to retain washer 324 in place. Housing 304 is mounted to housing 30 by a mounting sleeve 330 connected thereto and secured to housing 30 by a retaining ring 332.

From a review of FIG. 4A, it will be appreciated that if lock system 10 is in a locked condition, such as by any of locks 14, 16 or 20 (FIG. 1) not being properly accessed or unlocked, cam 130 will not be capable of rotating completely to retract draw bar 120 as shown in FIG. 3B. Instead, cam 130 will be stopped by draw bar 120 and clutch assembly 300 will operate. Specifically, referring to FIG. 4C, torque sensor 302 will be rotated by shaft 128 and teeth 306 will bear against teeth 308 until sufficient torque causes teeth 306 to ride upwardly, as viewed in FIG. 4C, with respect to teeth 308. In this regard, torque sensor 302 will translate upwardly against the bias provided by springs 318, 320 and, in this manner, shaft 128 and therefore door handle 18 will slip until tab 280 reaches stop 283*a* or 283*b* (FIGS. 10 and 11) and no further force will be transferred between cam 130 and draw bar 120.

Inside Escape Lever

Figure 12:
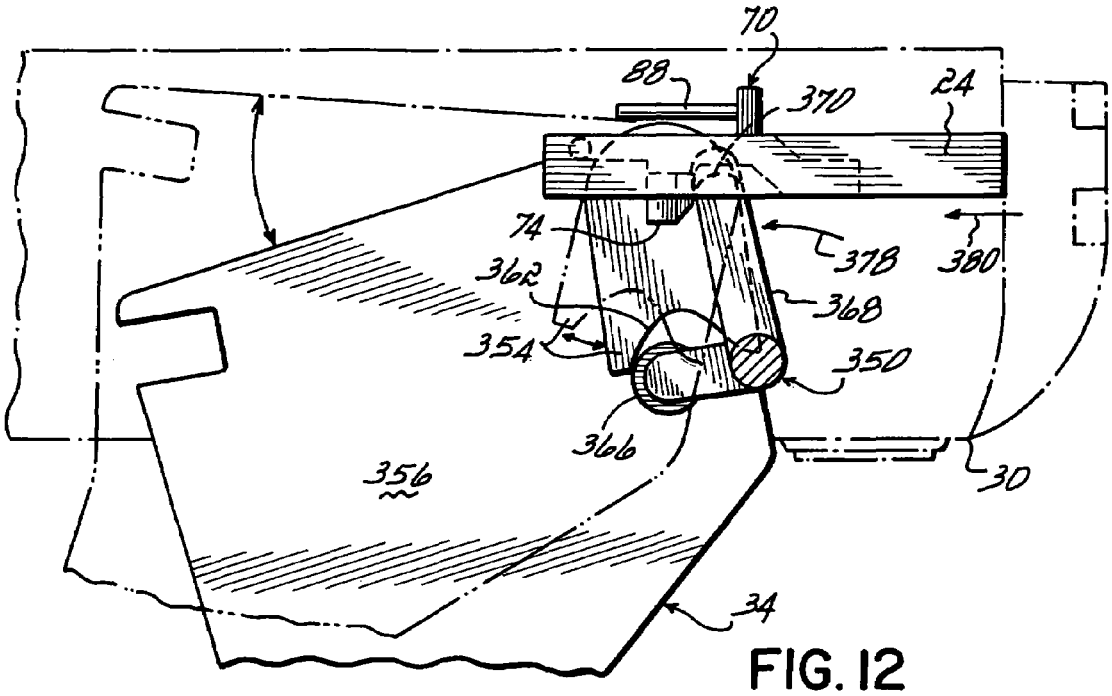
FIG. 12 is a diagrammatic view of the operation of the escape lever mechanism associated with the lock system.

Turning now to FIGS. 12 and 13, escape lever 34 operates to retract dead bolt 24 regardless of the locked or unlocked condition of any other feature in lock system 10 except the relock feature discussed below. The main component actuated by lever 34 is a roller arm 350 actuated by a pair of cam members 352, 354 affixed on opposite side members of escape lever 34. Cam members 352, 354 include respective concave surfaces 360, 362 that engage respective rollers 364, 366 of roller arm 350. An extension 368 of roller arm 350 includes a recessed portion 370 at one end which engages dead bolt actuating member 70, and specifically arm 74 thereof, as shown best in FIG. 12. As will further be appreciated from FIGS. 6, 12 and 13, lower convex surfaces 372, 374 are respectively received within concave mounting portions 376 contained within housing 30. Therefore, it will be appreciated that escape lever 34 may be either pushed or pulled with respect to housing 30 and convex surfaces 372, 374 will rotate or pivot within concave mounting portions 376. As further shown in FIG. 12, rollers 364, 366 will ride along concave surfaces 360, 362 of cam members 352, 354. FIG. 12 shows one extreme position for escape lever 34 in solid lines and the other extreme position in phantom. The normal neutral position is located centrally between these extremes. The position of rollers 364, 366 and, therefore, the pivoted location of roller arm 350 is the same in either actuated position of lever 34. As shown in FIG. 12, in these positions of lever 34, roller arm 350 has rotated and moved generally in the direction of arrow 378 such that extension 368 pushes against arm 74 of actuator member 70 generally in the same direction to retract dead bolt 24 in the direction shown by arrow 380. Once retracted, dead bolt 24 will be retained in this position by pivoting hold back element 186 as described above with reference to FIG. 3B.

Figure 15:
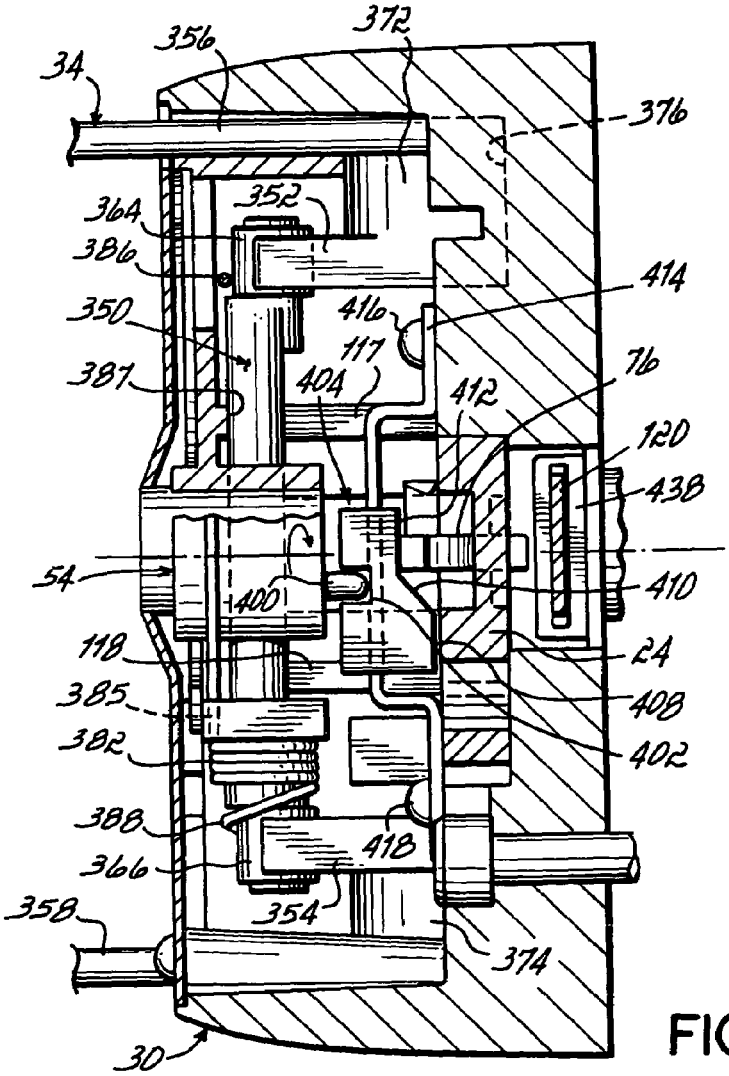
FIG. 15 is a fragmented cross sectional view showing more particular elements associated with the lock down or night latch feature and taken generally along line 15-15 of FIG. 14.

As will also be appreciated from a review of FIGS. 13 and 15, a coil spring member 382 is mounted to cap 55 in notches 384, 385 and includes ends 386, 388 that extend over roller journals 364, 366 to retain these rollers against concave surfaces 360, 362. Spring element 382 thereby also forces escape lever 34 to be retained in the described neutral position between the two positions shown in FIG. 12 with rollers 364, 366 being retained at a central point on each of the concave surfaces 360, 362. Recesses 387 are provided on cap 55 for receiving roller arm 350 when assembled and holding arm 350 to rotate against the upper ends of posts 117, 118.

Night Latch/Lock Down Mechanism

Figure 14:
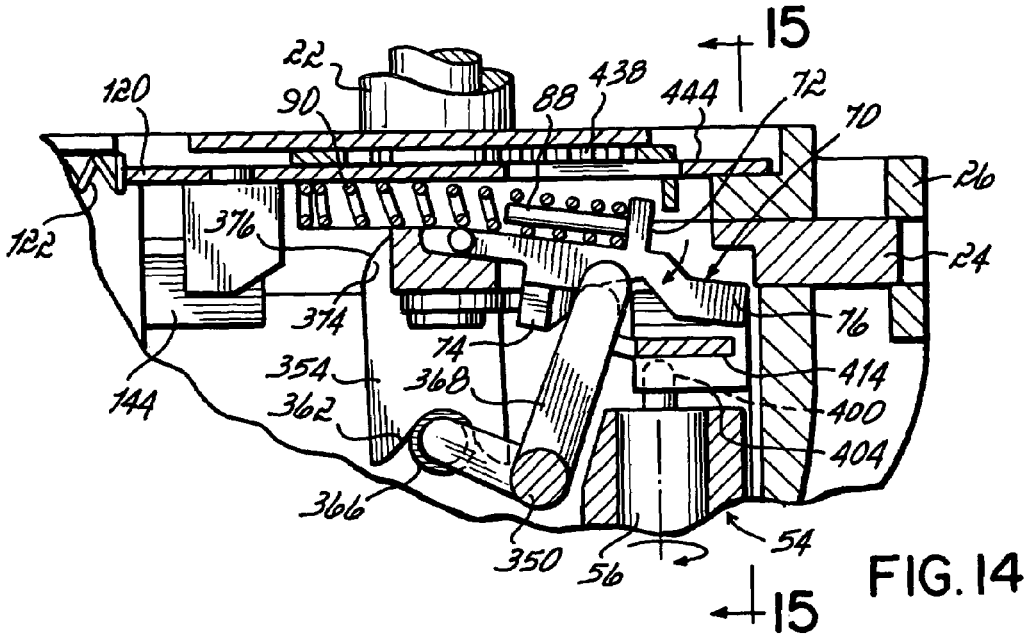
FIG. 14 is a cross sectional view similar to FIGS. 4A and 4B, but showing operation of the night latch or lock down feature of the invention.

As briefly mentioned with respect to FIG. 2, a night latch or lock down assembly 54 is also provided for allowing lock system 10 to be disabled with respect to use by operators situated outside door 12 (see FIGS. 1 and 2). As will be understood from the foregoing description taken in conjunction with the description of the operation of escape lever 34, escape lever 34 may still be used from within the secured area to retract dead bolt 24. As shown in FIG. 14, the more specific purpose of night latch or lock down assembly 54 is to completely disengage or isolate dead bolt actuating member 70 from draw bar 120 (FIG. 1), to be described below.

Figure 16:
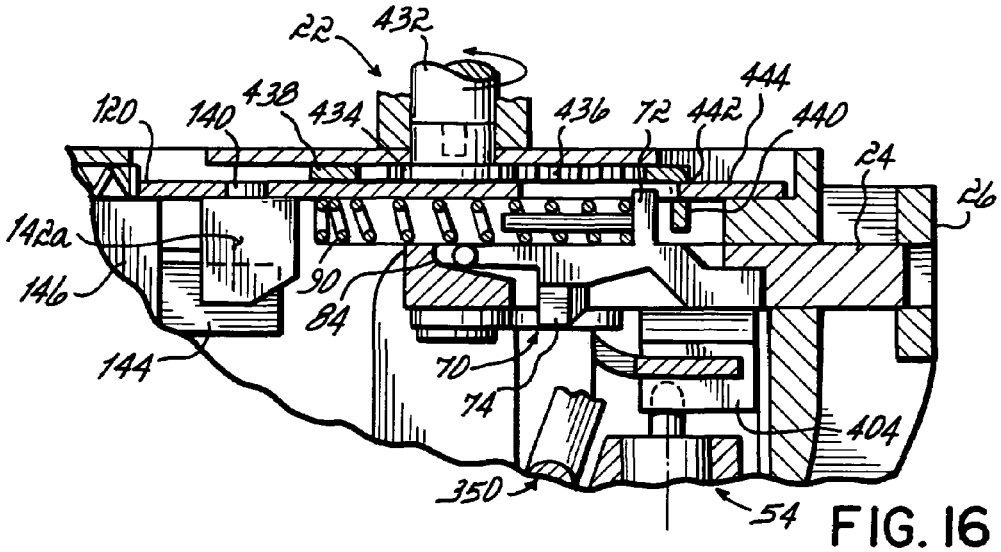
FIG. 16 is a fragmented cross sectional view of a portion of FIG. 4A showing a lock override portion of the dead bolt lock system.

Referring more specifically to FIG. 14, night latch or lock down assembly 54 is shown in an actuated or enabled condition which disengages arm 72 of dead bolt actuating member 70 from slot 136 contained in draw bar 120. Therefore, it will be understood that any movement of draw bar 120 to the left, as viewed in FIG. 14, will not act to retract actuating member 70 and, therefore, will not act to retract dead bolt 24. Referring to FIGS. 14 and 15, turning key cylinder 56 through the use of an appropriate key inserted into slot 56*a* (FIG. 2) will rotate an eccentric pin 400 contained within a slot 402. It will be appreciated that the key and key cylinder may be replaced by other actuating structure such as a rotatable knob. As best shown in FIGS. 15 and 16, slot 402 is contained within a surface of a slidable cam member 404 having a cam surface 406 on a side opposite to slot 402. Cam surface 406 engages the forward end 76 of dead bolt actuating member 70. In the normal, non-enabled condition of night latch or lock down assembly 54, end 76 of dead bolt actuating member 70 will engage surface portion 408 as best shown in FIG. 4A such that dead bolt actuating member 70 is in the normal operating position shown. However, when key cylinder 56 is rotated 180 degrees, as shown in FIGS. 14 and 15, end 76 will be forced down ramp surface 410 under the bias of spring 90 until it bears against cam surface portion 412. As also best shown in FIG. 15, cam member 404 slides along a support rail 414 which is fastened to housing 30 by fasteners 416, 418.

Lock Override Mechanism

As mentioned above, an optional lock override mechanism 22 may be provided on the outside of door 12 as shown in FIGS. 1 and 4A. This override 22 allows the other locks or access devices, such as locks 14 and 16 and access control 20 to be bypassed with a suitable key inserted into a key slot 430 and rotated to turn a key cylinder 432.

Referring generally to FIG. 13, key cylinder 432 includes a pinion gear 434 connected to the inner end for engaging a rack 436 of a dead bolt retraction member 438. Dead bolt retraction member 438 has a flange 440 with a slot 442 which receives an end portion 444 of draw bar 120 for sliding movement during operation of either draw bar 120 or dead bolt retraction member 438.

Figure 17:
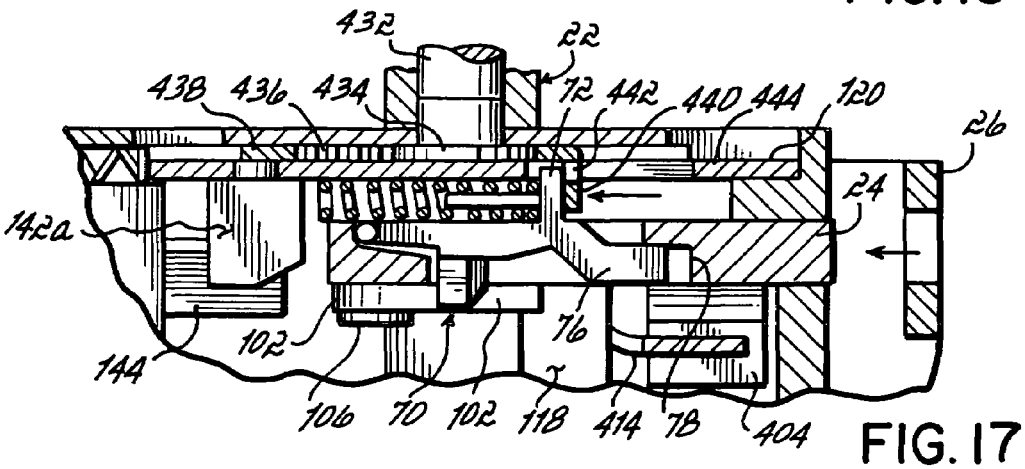
FIG. 17 is a cross sectional view similar to FIG. 16 but showing the lock override system in an actuated condition to retract the dead bolt.

Referring more specifically to FIGS. 16 and 17, FIG. 16 illustrates lock system 10 with dead bolt 24 in an extended, locked condition within bail 26. In this condition, flange 440 of dead bolt retraction member 438 is disposed adjacent arm 72 of dead bolt actuating member 70. When key cylinder 432 is rotated approximately 60 degrees, pinion 434 will engage rack 436 and move dead bolt retraction member 438 to the left, as viewed in FIG. 17. Thus, flange 440 will pull dead bolt actuating member 70 to the left against the bias of spring 90 and retract dead bolt 24. Rotation of the key cylinder 432 in the opposite direction will allow dead bolt 24 to extend to the position shown in FIG. 16 under the bias of spring 90. This assumes that trigger member 28 has been actuated to deactivate the dead bolt hold back mechanism as described above.

Covers Locked on by Combination

Covers 42, 46 associated with housings 30, 32 (FIG. 2) and cover 212 associated with housing 213 (FIGS. 9A-9B) include locking features which help prevent removal of the covers, even when the appropriate fasteners are removed, unless the lock system 10 is in a completely unlocked condition with draw bar 120 in a retracted position. Thus, in the preferred embodiment an operator must place each security lock 14, 16 as well as access control 20 in an unlocked or properly accessed condition, and turn handle 18 to retract draw bar 120, in order for covers 42, 46, 212 to be removed from respective housings 30, 32, 213. As shown best in FIG. 13, for example, cover 42 includes a pair of legs 450, 452 having bends 454, 456 with notches 458, 460. As shown in FIG. 3A, housing 30 includes a pair of spring loaded levers 462, 464 which rotate about respective pivots 466, 468. Levers 462, 464 are respectively biased counterclockwise and clockwise by springs 470, 472 such that respective portions 474, 476 are biased outwardly against leg portions 454, 456. As appreciated from FIG. 7, if cover 42 is lifted from housing 30, lever 462 will move under the bias of spring 470 outwardly such that notch 458 is engaged by portion 474 to prevent further lifting of cover 42 from housing 30. Although only one lever 462 is shown in FIG. 7, it will be appreciated that the operation of lever 464 is the same. However, as shown in FIG. 3B, if draw bar 120 is retracted to the left, movement of levers 462, 464 in respective counterclockwise and clockwise directions will be prevented by draw bar portions 120*a*, 120*b*. Thus, cover 42 and legs 450, 452 may be lifted from housing 30 without obstruction.

Figure 18:
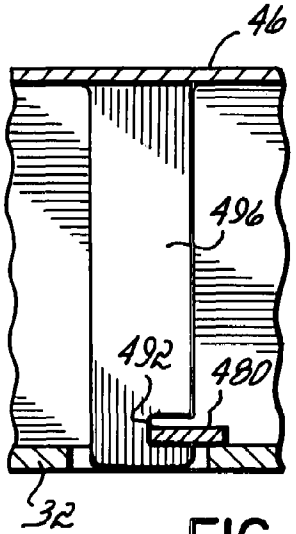
FIG. 18 is a cross sectional view taken along lines 18-18 of FIG. 3A.

The lock for normally retaining cover 46 of housing 32 in place is best described with respect to FIGS. 3A and 3B taken in conjunction with FIG. 18. Specifically, as shown in FIG. 3A, a lever 480 is mounted by a central pivot 482 within housing 32. Lever 480 includes an end 484 normally contained partially in a slot 486 within test lever 152. Thus, it will be appreciated that in this position, with test lever 152 retained in the position shown due to the extension of lock bolt 158, no rotation of lever 480 is possible. In this position respective portions 488, 490 of lever 480 are contained in notches 492, 494 in respective legs 496, 498 of cover 46, as illustrated by FIG. 18. However, when lock bolt 158 is retracted and test lever 152 is rotated clockwise by draw bar 120, as shown in FIG. 3B, test lever 152 will rotate lever 480 clockwise through the interaction of end 484 and test lever slot 486. This will disengage lever portions 488, 490 from notches 492, 494 of legs 496, 498 and allow removal of cover 46.

Referring now to FIGS. 9A and 9B, cover 212 of access control housing 213 also includes a pair of legs 500, 502 similar to legs 496, 498 of cover 46. Legs 500, 502 include notches 504, 506 which are engaged by test lever 216 when access control 210 is in a locked condition as shown in FIG. 9A. This prevents cover 212 from being lifted off of housing 213. However, when draw bar 120 is retracted as shown in FIG. 9B, test lever 216 will rotate clockwise to the position shown and will thereby disengage notches 504, 506 to allow cover 212 to be lifted from housing 213.

Relock Mechanisms

Figure 19:
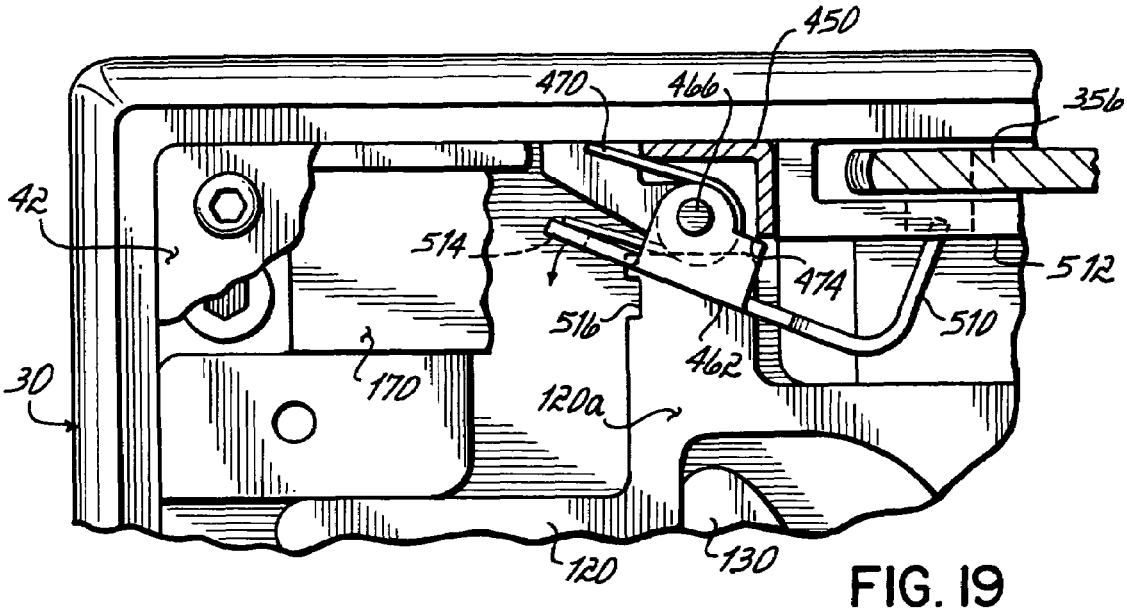
FIG. 19 is an enlarged, fragmented view of the lock housing including a lid relock feature in a normal position with the lid in place.
Figure 20:
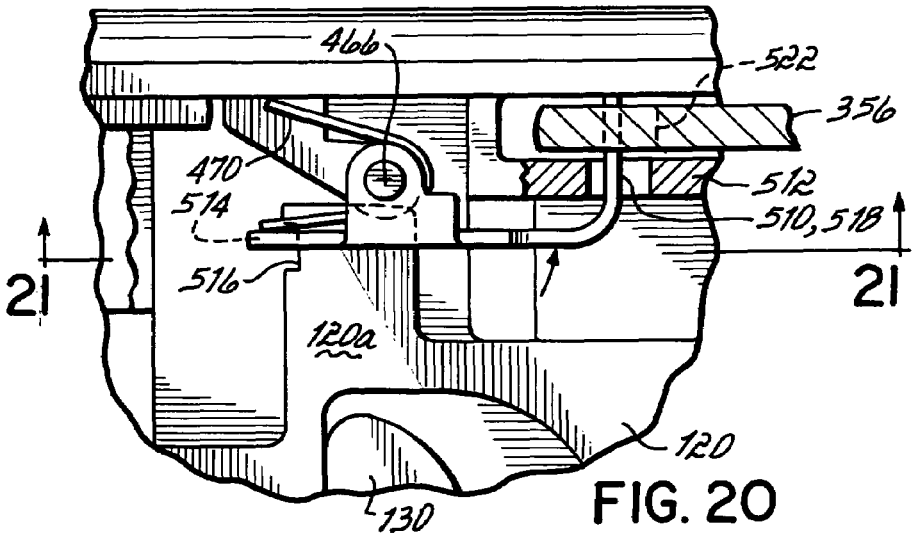
FIG. 20 is a view similar to FIG. 18, but showing the relock engaged when the cover of the housing is removed.
Figure 21:
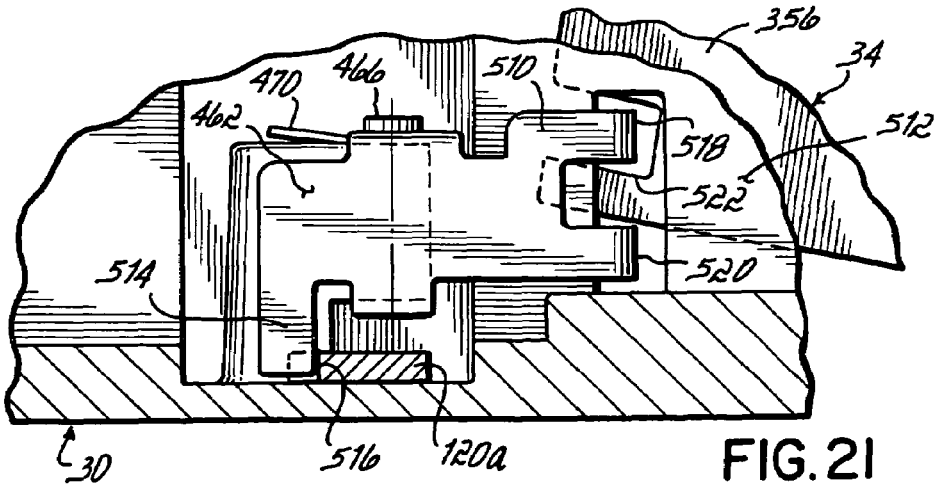
FIG. 21 is a cross sectional view taken along line 21-21 of FIG. 20.

Housings 30, 32, 213 each also include a relock feature which ensures that draw bar 120 cannot be retracted if any of the covers 42, 46, 212 have been removed. This further assists in preventing unauthorized entry past lock system 10. Referring to FIGS. 3A-B and 19-21, levers 462, 464 further function as relock levers and, as shown in FIG. 20, if cover 42 is removed, legs 450, 452 will no longer prevent levers 462, 464 from respectively rotating in counterclockwise and clockwise directions. FIGS. 19-21 specifically show the operation of relock lever 462, however, it will be understood that the operation of lever 464 is the same. As shown in FIG. 20, when cover 42 is removed, relock lever 462 will rotate under the bias of spring 470 to the position shown with portion 510 bearing against an inside wall 512 of housing 30. As shown in FIG. 21, this places a stop portion 514 of lever 462 in line with a notch 516 of draw bar 120. In this manner, stop portion 514 will obstruct retraction or movement of draw bar 120 to the left as shown in FIGS. 20 and 21. As further shown in FIG. 21, portion 510 of lever 462 includes a pair of arms 518, 520. Arm 518 is received within a notch of arm 356 associated with escape lever 34. Arm 520 is disposed adjacent an edge of side arm 356. In this manner, when lever 462 is biased against inside wall 512 of housing 30 as shown, movement of escape lever 34 in an amount sufficient to retract dead bolt 24 as described above is prevented. Portions of housing 30 may be disposed adjacent arms 518, 520 to accept excessive force applied to lever 34 in this relocked condition.

Figure 22:
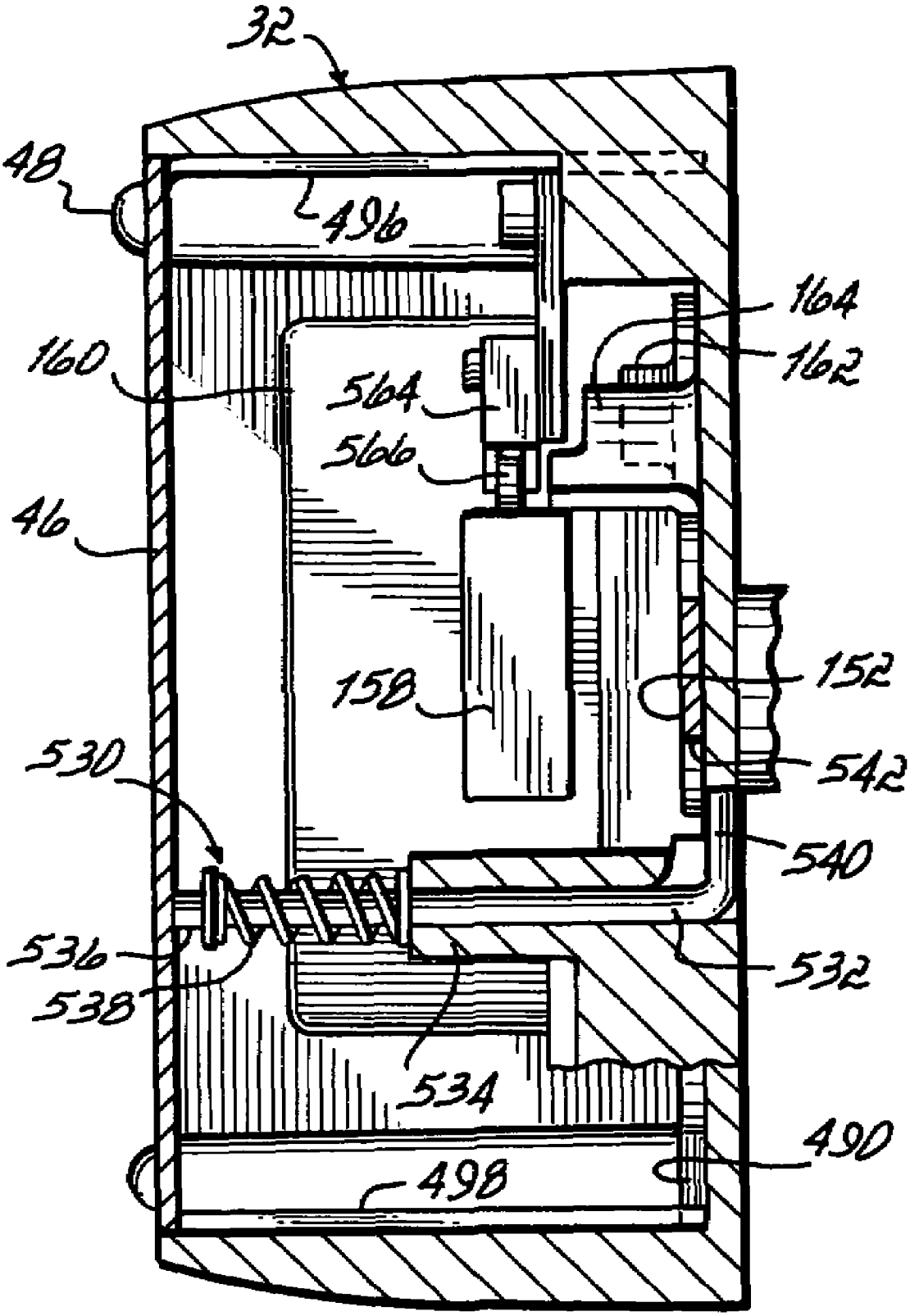
FIG. 22 is a cross sectional view taken generally along line 22-22 of FIG. 3A.

The relock device which is actuated by cover 46 associated with housing 32 is best described with reference to FIGS. 3A and 3B taken in conjunction with FIG. 22. In this regard, a relock device 530 is shown and, as best illustrated in FIG. 22, comprises an L-shaped pin 532 mounted for reciprocating movement within a support 534. An end 536 of pin 532 is biased against cover 46 by a compression coil spring 538. It will be appreciated that when cover 46 is removed, L-shaped pin 532 will be biased to the left, as viewed in FIG. 22, such that leg portion 540 of pin 532 will be in the same plane as test lever 152. As appreciated from a review of FIG. 3A, this leg portion 540 will therefore engage a lower edge of test lever 152 to prevent the unlocking, clockwise rotation thereof as previously described. In other words, draw bar 120 will not be capable of retracting to the left as shown in FIG. 3B due to the engagement of leg portion 540 with edge 542 of test lever 152.

Referring briefly to FIGS. 9A and 9B, the relock feature associated with cover 212 of external access control 210 is very similar to that described above with respect to housing 32. In this regard, a relock device 550 is provided with the same configuration as relock device 530. In the case of relock device 550, a spring loaded L-shaped pin 552 includes a leg portion 554 that will engage a lower edge 556 of test lever 216 if cover 212 is removed and access control 210 is in an unlocked condition as shown in FIG. 9A. This will prevent clockwise rotation of test lever 216 when a user attempts to retract draw bar 120 to the left. As shown in FIG. 9B, when cover 212 is in place, leg portion 254 is normally disposed on one side of test lever 216 and therefore does not provide any obstruction.

Lock Monitoring Switches

Referring briefly again to FIG. 3A, various electrical sensing devices may be used in carrying out the concepts of the present invention. For example, a microswitch 560 having a movable arm 562 is mounted within housing 30 such that arm 562 will be engaged by lock bolt 144 upon extension thereof. Another microswitch 564 is mounted within housing 32 and is actuated when lock bolt 158 extends and actuates a switch arm 566. Finally, another microswitch 568 may also be mounted within housing 30 such that an actuating arm 570 thereof is actuated by trigger member 28 when trigger member 28 is forced inwardly by door strike 198 (FIG. 4A). Microswitches 560, 564, 568, as well as additional switches or sensing devices, may be used to indicate the respective system conditions associated therewith on a suitable control panel. Switches 560, 564, 568 may be wired in series to indicate an overall locked or unlocked condition of system 10. Instead, they may be wired to separate indicators, such as lights, to indicate the separate conditions of locks 14 and 16 or trigger member 28. Trigger member 28 is specifically monitored to indicate an open or closed condition of door 12 (FIG. 1).

Additional switches or sensing devices may be associated with the internal access control device 20 or external access control device 210, or these devices may be monitored based on the signals provided by the respective solenoids 166, 230 associated therewith (see FIGS. 7 and 9A). Electrical sensing devices, such as switches 560, 564, 568 may also be used for audit or tracking purposes, and the same general functions may be supplied by the card reading device associated with access control 20 (FIG. 1). Finally, as mentioned above, electrical sensing devices, such as switches, may be situated as exemplified by switch 564 such that the actuating arm thereof acts as a test member to test the condition of a security lock associated with lock system 10. Such a switch or sensing device could then activate a suitable electromagnetic device, such as a solenoid, to render the dead bolt retracting structure associated with system 10 either operative or inoperative by door handle 18 (FIG. 1) as generally described in accordance with the invention.

Figure 23A:
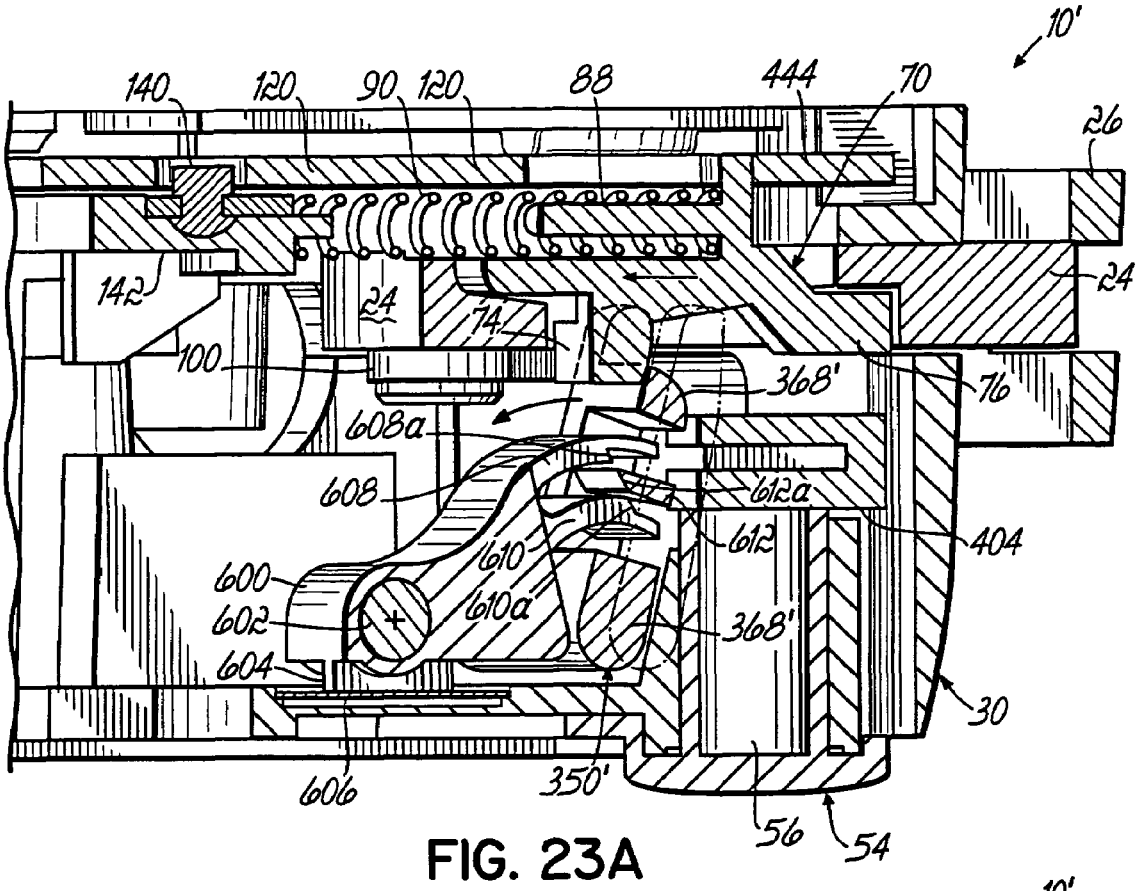
FIG. 23A is a perspective view, in cross section, of the internal area of the lock generally shown in FIG. 14 as well, but illustrating an alternative embodiment which includes an inertia operated impact resistance feature.
Figure 23B:
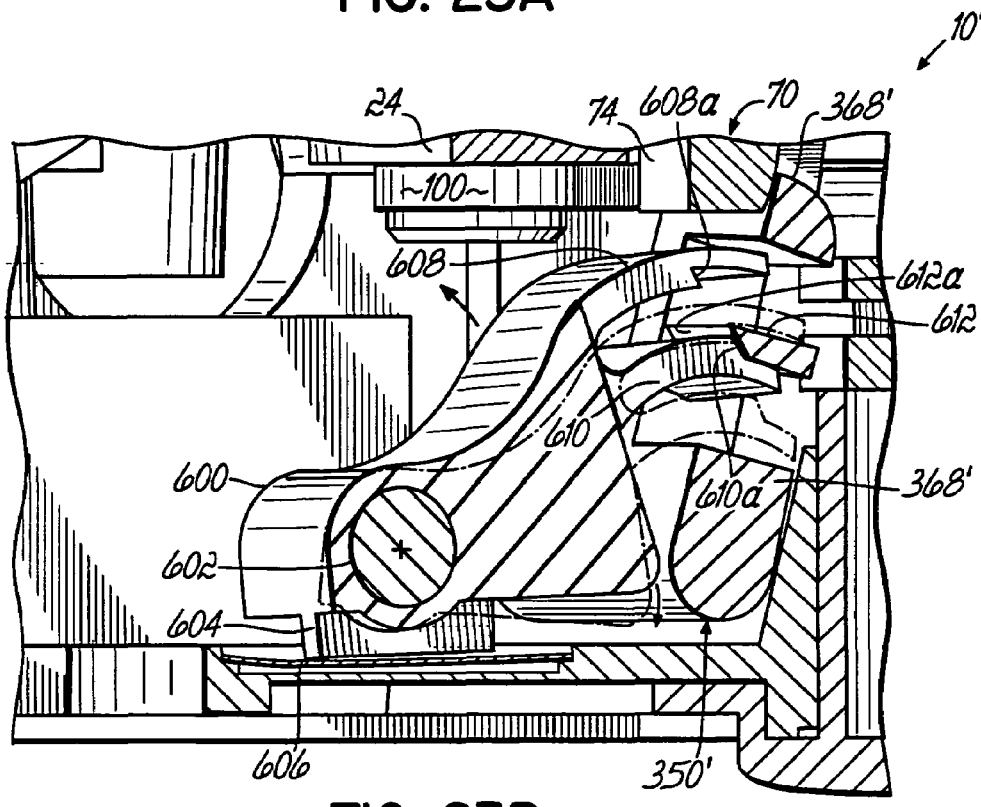
FIG. 23B is an enlarged view similar to FIG. 23A, but illustrating pivoting actuation of the inertia bar associated with the impact resistant feature.

FIGS. 23A and 23B illustrate a view similar to FIG. 14 (without illustrating the actuation of the night latch or lock down feature), but modified to include an impact resistance feature. Without this feature, it may be possible in certain instances to impact the front side or rear side of the lock or the door associated with the lock thereby causing the escape lever or handle to actuate under its own weight, and due to inertia. This inertial movement of the escape lever can then cause retraction of the dead bolt 24 in some cases. In FIGS. 23A and 23B, like reference numerals are used to describe like components with the previously described embodiments and, therefore, additional description of these components and their operation is not necessary. Reference numerals having prime marks (') have corresponding structure in the previously described embodiments, but are slightly modified in the embodiment shown in FIGS. 23A and 23B to accommodate the impact resistance feature as discussed below.

More specifically, a pivoting inertia bar 600 is connected for rotation about a pivot 602 and includes a lower flange portion 604 which rests against a flat leaf spring 606. The opposite end of inertia bar 600 includes first and second spaced apart stop members 608, 610. Roller arm 350' has been modified, as compared to the previous embodiments, in that its extension 368' includes a slot which carries a cam element 612 having a cam surface 612*a*. Cam surface 612*a* is configured to engage either cam surface 608*a* of stop member 608 or cam surface 610*a* of stop member 610 depending on whether inertia bar 600 rotates clockwise (as shown in phantom lines in FIG. 23B) or counterclockwise (as shown in solid lines in FIG. 23B) which depends on whether impact has occurred from the front side or rear side of the lock. In the case of either type of impact, inertia bar 600 will rotate such that cam surface 608*a* engages cam surface 612*a* or cam surface 610*a* engages cam surface 612*a*. Either type of engagement will momentarily prevent rotation of roller arm 350' to the left (as view in FIGS. 23A, 23B) and thereby prevent rotation of actuating member 70. Without the presence of stop members 608, 610, such an impact may cause enough inertial movement of extension 368' against actuating member 70 to cause retraction of dead bolt 24. Inertia bar 600 is shaped as shown and formed of a heavy material, such as steel, so that its clockwise or counterclockwise rotation occurs quicker than the pivoting movement of roller arm 350' which may be caused by an impact. Cam surfaces 608*a*, 610*a*, 612*a* are chosen at respective angles of about 301 such that more forceful movement of roller arm 350', such as by a person desiring egress from a high security area secured by lock system 10' can still occur. In such a case, if roller arm 350' is more forcefully rotated to the left against member 70 by either pushing or pulling escape lever 34 (FIG. 12) as previously described, then cam surface 612*a* will ride off of either cam surface 608*a* or cam surface 610*a* depending on whether inertia bar 600 has pivoted clockwise or counterclockwise to the engaged position shown in FIG. 23B. Normally, however, leaf spring 606 will cause inertia bar 600 to pivot such that stop members 608, 610 are positioned centrally relative to cam member 612 as shown in FIG. 23A. In this position, unrestricted movement of roller arm 350' is allowed during normal operation of lock system 10'.

Figure 24:
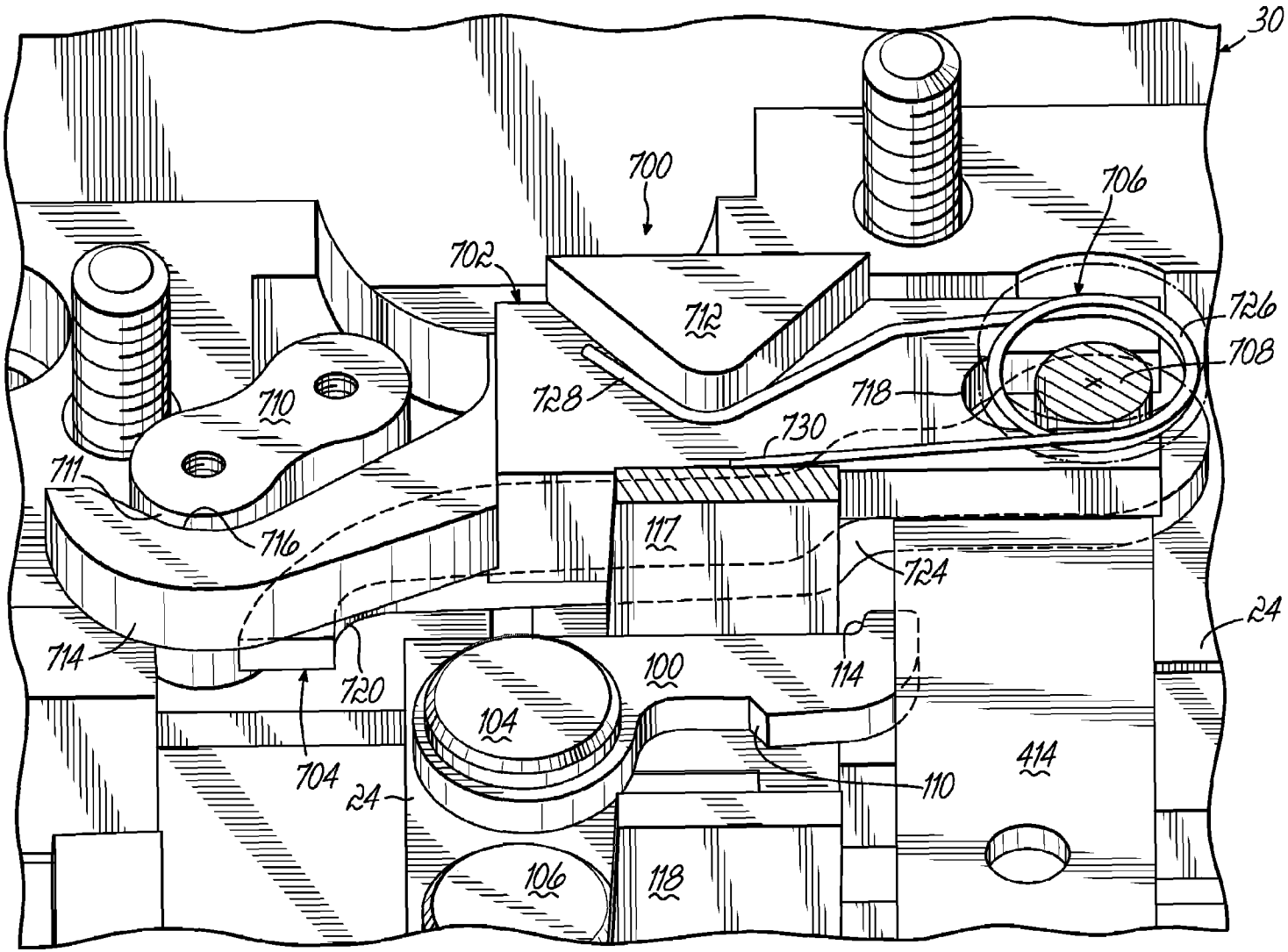
FIG. 24 is an enlarged view similar to FIG. 6, but illustrating an inertia assembly associated with preventing movement of the dead bolt during application of a shock load.
Figure 25A:
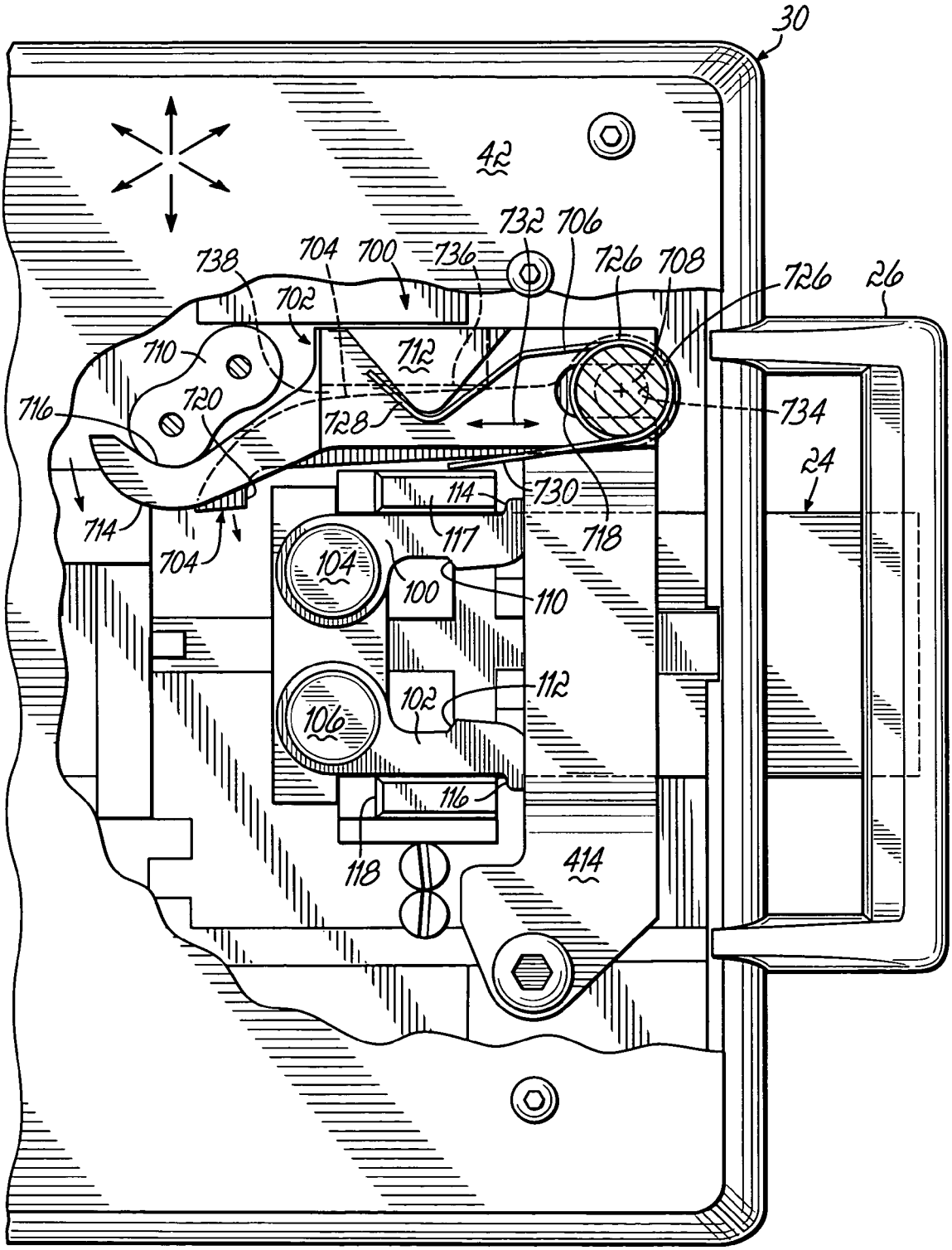
FIG. 25A is an elevated plan view partially fragmented to illustrate the inertia assembly when a shock load is not being applied.
Figure 25B:
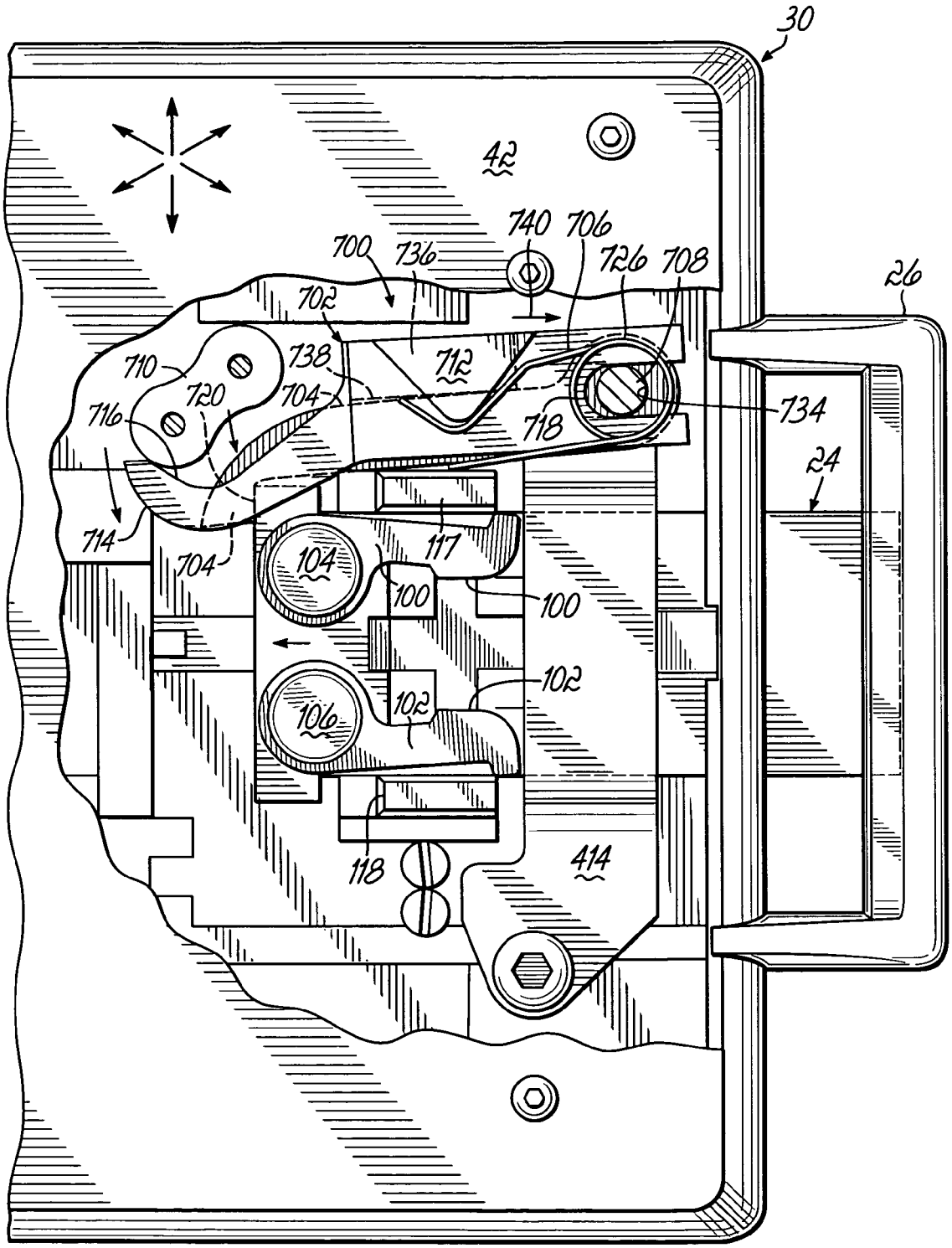
FIG. 25B is an elevated plan view partially fragmented to illustrate the inertia assembly when a shock load is being applied in a first direction.
Figure 25C:
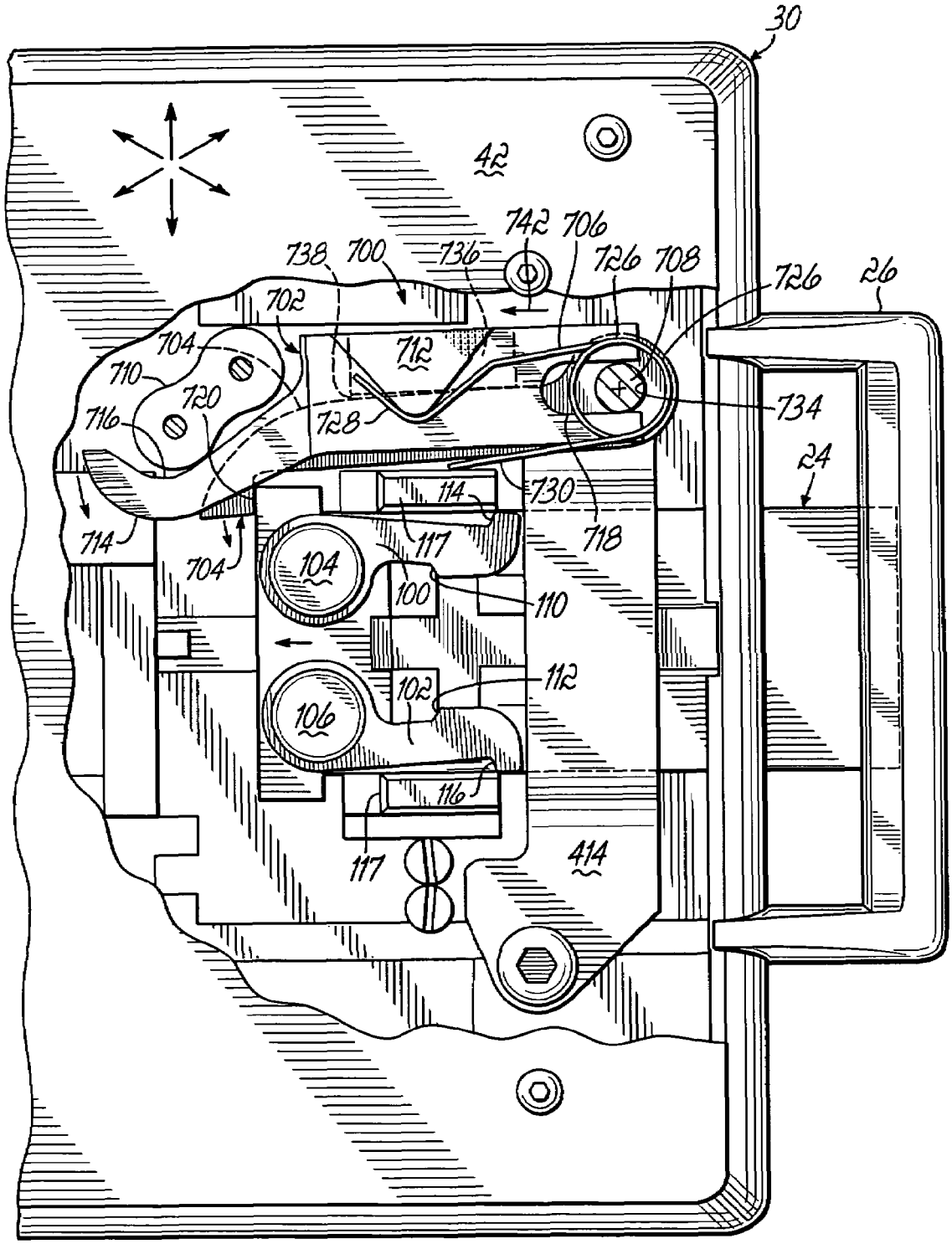
FIG. 25C is an elevated plan view partially fragmented to illustrate the inertia assembly when a shock load is being applied in a second direction generally opposite to the first direction.
Figure 26:
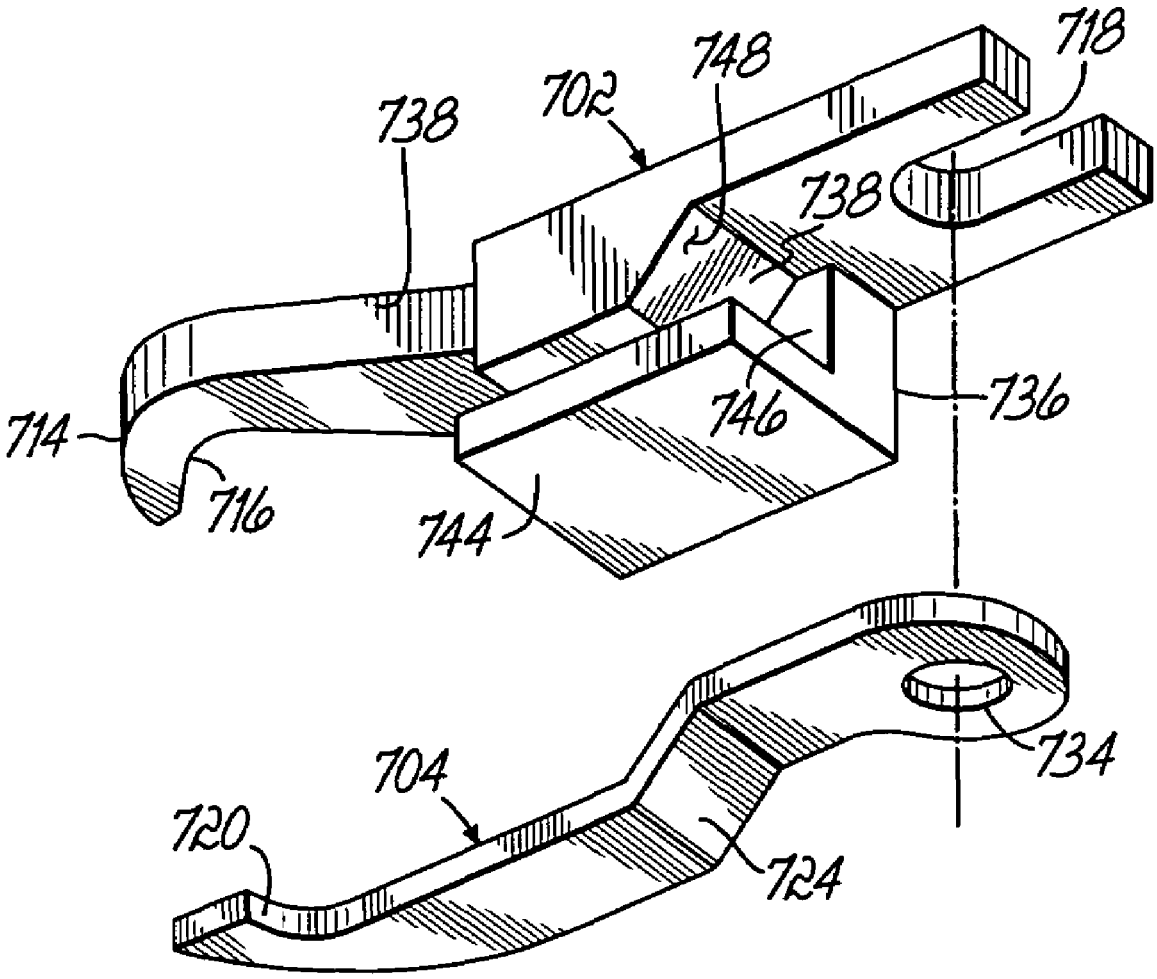
FIG. 26 is an elevated rear perspective view illustrating how the actuator weight and the bolt lock lever fit together.

Another impact resistance feature is described in FIGS. 24-26. FIG. 24 illustrates a view similar to FIG. 6 (except that is enlarged close to the dead bolt 24), but modified to include an inertia assembly 700 operatively coupled to the housing 30. Without this feature, it may be possible in certain instances to apply a shock load to the door potentially causing the dead bolt 24 to move in some cases. A shock load is a high level of force applied over a short period of time, such as hitting the door with a sledgehammer. The application of shock loads to the door can occur during an unauthorized entry attempt. FIG. 25A illustrates first the positioning of the inertia assembly 700 during normal operation and then FIGS. 25B-C illustrate the movement of the inertia assembly 700 during application of a shock load. In FIGS. 24 and 25A-C, like reference numerals are used to describe like components with the previously described embodiments and, therefore, additional description of these components and their operation is not necessary.

Referring to FIG. 24, the inertia assembly 700 includes an actuator weight 702 for providing a body having sufficient inertia to resist movement during application of a shock load, a bolt lock lever 704 coupled to the actuator weight 702 for restraining the dead bolt 24, a return spring 706 for biasing the inertia assembly 700 towards a neutral position enabling the dead bolt 24 to retract, a stud 708, illustrated in phantom in FIG. 24, for coupling the actuator weight 702, the bolt lock lever 704, and the return spring 706 together and to the housing 30, and a curved post 710 for facilitating the rotation of the actuator weight 702 during the application of the shock load.

The actuator weight 702 includes a wedge post 712 for cooperating with the return spring 706 to return the actuator weight 702 to a neutral position after a shock load has been applied. The actuator weight 702 also includes an arm 714 that defines a notch 716 that defines a cam surface that cooperates with a cam surface 711 on the curved post 710 to rotate the actuator weight 702 during a shock load. The actuator weight 702 also includes a slot 718 that receives the stud 708 and is designed to allow translation of the actuator weight 702 during application of a shock load. The actuator weight 702 also includes a passageway (not shown) that receives the bolt lock lever 704 and causes the bolt lock lever 704 to rotate when the actuator weight 702 rotates. A more detailed description of the passageway (not shown) is provided hereinbelow in FIG. 26. In the illustrated embodiment, the actuator weight 702 is formed out of brass, however, in other embodiments other metals and materials are used.

The bolt lock lever 704 is positioned in the passageway (not shown) of the actuator weight 702 and a detailed explanation of the positioning of the bolt lock lever 704 in the actuator weight is provided in FIG. 26. The bolt lock lever 704 includes a hook 720 that restrains the dead bolt 24 when the hook 720 rotates counterclockwise towards the dead bolt 24. The rotation of the hook 720 is tied to the rotation of the arm 714 of the actuator weight 702 since the passageway (not shown) contains the bolt lock lever 704. The bolt lock lever 704 also includes an opening 734 that receives the stud 708 and becomes a fixed point that the rest of the bolt lock lever 704 rotates around. In addition, the bolt lock lever 704 includes a step 724 that positions the hook 720 low enough to restrain the dead bolt 24 during the application of a shock load. The bolt lock lever 704 of the illustrated embodiment is formed of stainless steel, however, other embodiments use other materials.

The return spring 706 is positioned on the actuator weight 702. The return spring 706 of the illustrated embodiment is formed of music wire. The return spring 706 includes a single coil 726 that is wrapped around the stud 708 thereby keeping the single coil 726 in place. The return spring 706 also includes a notched arm 728 that acts as a cam surface against the wedge post 712 and a straight arm 730 that is functionally coupled to the stationary post 117. The arms 728, 730 are biased to move away from one another. Accordingly, the notched arm 728 will exert a force on the wedge post 712 encouraging the point of the wedge post 712 to be contained by the notched arm 728 as illustrated in FIG. 24. The notched arm 728 therefore biases the wedge post 712 in a clockwise rotational direction. During a shock load, the force exerted by the lateral movement of the wedge post 712 with the actuator weight 702 exceeds the clockwise torque applied by the wedge post 712 by the notched arm 728, however, after the application of the shock load the notched arm 728 will move the actuator weight 702 back into the neutral position illustrated in FIG. 24.

FIGS. 25A-C illustrate the operation of the inertia assembly 700. FIG. 25A illustrates that the inertia assembly 700 can translate in two directions. The two arrows 732 on the actuator weight 702 illustrate the direction of translation. In this embodiment, the dead bolt 24 is extended, however, the positioning of the inertia assembly 700 in the illustrated embodiment enables the dead bolt 24 to extend and retract. The return spring 706 holds the actuator weight 702 in a neutral position and therefore the bolt lock lever 704 is free to rotate around the stud 708 that passes through the opening 734. The bolt lock lever 704 can move out of the path of the dead bolt 24 or into the path of the dead bolt 24. The movement of the bolt lock lever 704 out of the actuator weight is illustrated by showing the space between the bolt lock lever 704 and the carriage 736 (shown in hidden lines) of the actuator weight 702. The carriage 736 defines the passageway 738 (shown in hidden lines) that contains the bolt lock lever 704. A more detailed description of the combination of the actuator weight 702 and the bolt lock lever 704 is provided hereinbelow with respect to FIG. 26. If the bolt lock lever 704 is in the path of the dead bolt 24 the dead bolt 24 will apply a clockwise torque to the bolt lock lever 704 to move it out its path during retraction.

FIG. 25B illustrates when a shock load has been applied to the door in one direction along the main axis of the dead bolt 24. The shock load causes the inertia assembly 700 to translate towards the dead bolt 24 in its extended position as illustrated by arrow 740. As the actuator weight 702 translates towards the extended dead bolt 24, the notch 716 in arm 714 begins to slide against the cam surface 711 on curved post 710. The curved post 710 applies a counterclockwise torque to the actuator weight 702 causing it to rotate counterclockwise around the stud 708. Simultaneously, the bolt lock lever 704 rotates counterclockwise around the stud 708. This rotation places the hook 720 into position to restrain the dead bolt 24 as shown in hidden lines in FIG. 25B. The inertia of the actuator weight 702 is selected to apply a greater counterclockwise torque on the bolt lock lever 704 than the dead bolt 24 can apply clockwise. In addition, the angle of the notch 716 and the differences in lever arm between the actuator weight-curved post lever arm and the actuator weight-bolt lock lever arm multiply the counterclockwise torque applied. Thus, even though the dead bolt 24 is attempting to retract in response to the application of the shock load the inertia assembly 700 prevents the retraction. When the shock load is no longer being applied, the return spring 706 will apply a clockwise torque to return the actuator weight 702 back to its original neutral position.

FIG. 25C illustrates the application of a shock load in an opposite direction to the shock load applied in FIG. 25B as shown by avow 742. The actuator weight 702 translates away from the dead bolt 24 in its extended position in response to the shock load. The notch 716 in arm 714 begins to slide on a different portion of the cam surface 711 on curved post 710. The curved post 710 applies a counterclockwise torque. In response to the torque applied by the curved post 710, the arm 714 and the actuator weight 702 rotate counterclockwise around the curved post 710. Simultaneously, the hook 720 rotates counterclockwise and restrains the dead bolt 24 from retracting inside of the door. The U-shaped design of the notch 716 enables a counterclockwise rotation of the actuator weight 702 regardless the direction that the actuator weight 702 translates. Accordingly, the inertia assembly 700 ensures no accidental retraction of the dead bolt 24 occurs when shock loads are applied.

FIG. 26 illustrates how the actuator weight 702 and the bolt lock lever 704 cooperate together. The slot 718 of the actuator weight 702 aligns with the opening 734 of the bolt lock lever 704 to provide a pivot point to facilitate the rotation of both the actuator weight 702 and the bolt lock lever 704. In addition, the carriage 736 includes a bottom portion 744 and a sidewall portion 746 that form a L-shape for holding the bolt lock lever 704 in place. The carriage 736 defines the passageway 738 that holds the bolt lock lever 704. The step 724 of the bolt lock lever 704 rests against the inclined surface 748 of the actuator weight. Accordingly, when the actuator weight 702 rotates counterclockwise the bolt lock lever 704 also rotates counterclockwise because the sidewall portion 746 contacts the bolt lock lever 704 and the passageway 738 provides room for additional movement outside of the carriage 736.

While the present invention has been illustrated by a description of various embodiments and while these embodiments have been described in considerable detail, it is not the intention of the Applicants to restrict or in any way limit the scope of the appended claims to such detail. Additional advantages and modifications will readily appear to those skilled in the art. For example, the various aspects and features of this invention may be used in either a combined fashion or a singular fashion in a lock system designed for many different application requirements, depending on user preferences or the needs of particular applications. The invention in its broader aspects is therefore not limited to the specific details, representative apparatus and operation of the system as shown and described. The invention itself should only be defined by the appended claims, wherein I claim:

The invention claimed is:

1. A dead bolt locking system for use on a door leading to a secure area, the dead bolt locking system comprising:

a housing structure adapted to be mounted on an inside of the door;

a dead bolt mounted in the housing structure for movement between extended and retracted positions;

a lock operatively connected with the dead bolt and controlled by the input of correct unlocking information to allow movement of the dead bolt from the extended position to the retracted position;

dead bolt retracting structure operatively connected to the dead bolt such that when the lock is unlocked, at least a portion of the dead bolt retracting structure is operative to allow retraction of the dead bolt and, when the lock is locked, operation of the dead bolt retracting structure is prevented thereby preventing retraction of the dead bolt; and an inertia assembly mounted to the housing structure, the inertia assembly having an actuator weight configured to rotate and translate relative to a pivot axis during the application of a shock load and a bolt lock lever configured to rotate about the pivot axis when the actuator weight translates relative to the pivot axis, the bolt lock lever including a portion that has a contacting relationship with a portion of the dead bolt, when the actuator weight and the bolt lock lever rotate about the pivot axis, to prevent movement of the dead bolt from the extended position to the retracted position and that has a non-contacting relationship with the portion of the dead bolt in the absence of the shock load.

2. The dead bolt locking system of claim 1 wherein the actuator weight has an arm and a slot in the arm configured to enable rotation and translation of the actuator weight during the application of the shock load; and a bolt lock lever operatively coupled to the actuator weight, the bolt lock lever including a hook for contacting the portion of the dead bolt when the actuator weight and the bolt lock lever rotate about the pivot axis and an opening aligned with the slot.

3. The dead bolt locking system of claim 2 wherein the inertia assembly further comprises:

a return spring configured for biasing the actuator weight about the pivot axis; and a stud extending through the return spring, the opening of the bolt lock lever, and the slot of the actuator weight for coupling to the housing structure, the stud providing the pivot axis;

wherein application of the shock load causes the actuator weight to translate by sliding the slot relative to the stud.

4. The dead bolt locking system of claim 3 wherein the arm of the actuator weight further includes a cam surface, and the inertia assembly further comprises:

a curved post coupled to the housing structure, said curved post including a cam surface cooperating with the cam surface on the arm of the actuator weight to rotate the actuator weight and the bolt lock lever when the actuator weight translates.

5. The dead bolt locking system of claim 1 wherein the inertia assembly further comprises:

a return spring configured for applying a torque to the actuator weight to return the actuator weight to a neutral position after the application of a shock load.

6. A dead bolt locking system for use on a door leading to a secure area, the dead bolt locking system comprising:

an enclosed housing structure having an interior and adapted to be mounted to the door;

a dead bolt mounted in the interior of the housing structure for movement between an extended position in which a portion of the dead bolt extends out of the interior of the housing structure and a retracted position in which the dead bolt is more fully contained within the interior of the housing structure;

a security lock including a casing and a lock member each contained within the interior of the housing structure and the lock member moved from a locked condition extending outwardly from the casing to an unlocked condition retracted within the casing by the input of correct unlocking information;

dead bolt retracting structure operatively connected to the dead bolt for moving the dead bolt from the extended position to the retracted position, the dead bolt retracting structure having a slotted opening with a first portion extending transversely relative to the direction of movement of the lock member and a second portion extending substantially parallel to the direction of movement of the lock member;

a test member mounted within the housing structure and having a portion movable within the first and second portions of the slotted opening as the dead bolt retracting structure moves the dead bolt from the extended position to the retracted position, the test member further mounted for movement relative to the dead bolt and coupled with the dead bolt retracting structure to prevent retraction of the dead bolt when the lock member is in the locked condition and movable into a space created by the lock member in the unlocked condition to thereby allow retraction of the dead bolt; and an inertia assembly mounted to the housing structure, the inertia assembly having a portion configured for contacting a portion of the dead bolt to prevent movement of the dead bolt to the retracted position during the application of a shock load.

7. The dead bolt locking system of claim 6 wherein a portion of the inertia assembly translates and rotates to prevent movement of the dead bolt to the retracted position during the application of a shock load.

8. The dead bolt locking system of claim 6 wherein the inertia assembly further includes cam surfaces configured for moving a portion of the inertia assembly into a position during the application of a shock load to prevent movement of the dead bolt.

9. The dead bolt locking system of claim 6 wherein a portion of the inertia assembly is configured to prevent movement of the dead bolt from the application of a shock load from a first direction or a second direction generally opposite to the first direction.

10. The dead bolt locking system of claim 6 wherein the inertia assembly further comprises:

an actuator weight having an arm configured for rotational movement and a slot in the arm configured to enable translation of the arm of the actuator weight during the application of the shock load; and a bolt lock lever operatively coupled to the actuator weight, the bolt lock lever including a hook configured for restraining the dead bolt and an opening aligned with the slot.

11. The dead bolt locking system of claim 10 wherein the inertia assembly further comprises:

a return spring configured for biasing the actuator weight in a rotational direction; and a stud passing through the return spring, the opening of the bolt lock lever, and the slot of the actuator weight, the stud configured for coupling to the housing structure and providing a pivot for enabling the rotation of the actuator weight and the bolt lock lever;

wherein application of the shock load causes the actuator weight to translate by sliding the slot relative to the stud.

12. The dead bolt locking system of claim 11 wherein the inertia assembly further comprises:

a curved post coupled to the housing structure cooperating with the arm of the actuator weight to rotate the actuator weight and the bolt lock lever when the actuator weight translates.

13. The dead bolt locking system of claim 12 wherein the rotation of the bolt lock lever prevents retraction of the dead bolt during application of the shock load.

14. The dead bolt locking system of claim 6 wherein a portion of the inertia assembly moves rotationally to prevent movement of the dead bolt during application of the shock load.

15. The dead bolt locking system of claim 6, wherein the inertia assembly further comprises:

a return spring for applying a torque to the actuator weight to return the actuator weight to a neutral position after the application of a shock load.

* * * * *

UNITED STATES PATENT AND TRADEMARK OFFICE

CERTIFICATE OF CORRECTION

PATENT NO. : 7,424,814 B2
APPLICATION NO. : 11/315622
DATED : September 16, 2008
INVENTOR(S) : Thomas E. Jasper It is certified that error appears in the above-identified patent and that said Letters Patent is hereby corrected as shown below:

In column 6, line 31, change “disassemble” to --disassembled--.

In column 7, line 1, change “lines” to --line--.

In column 9, line 2, change “ill” to --in--.

Column 18:
Line 42, change “view” to --shown--.
Line 51, change “301” to --30°--.

Column 20:
Line 36, before “its”, insert --of--.
Line 65, change “avow” to --arrow--.

In column 21, line 31, change “Applicants” to --Applicant--.

Signed and Sealed this

Fourteenth Day of July, 2009

John Doll

JOHN DOLL
*Acting Director of the United States Patent and Trademark Office*